US010051983B2

(12) United States Patent
Peterson

(10) Patent No.: US 10,051,983 B2
(45) Date of Patent: Aug. 21, 2018

(54) CEREAL BOWL

(71) Applicant: Bradley Peterson, Eden Prairie, MN (US)

(72) Inventor: Bradley Peterson, Eden Prairie, MN (US)

( * ) Notice: Subject to any disclaimer, the term of this patent is extended or adjusted under 35 U.S.C. 154(b) by 156 days.

(21) Appl. No.: 15/082,881

(22) Filed: Mar. 28, 2016

(65) Prior Publication Data

US 2016/0374485 A1 Dec. 29, 2016

Related U.S. Application Data

(60) Provisional application No. 62/184,959, filed on Jun. 26, 2015.

(51) Int. Cl.

| | |
|---|---|
| ***A47G 19/00*** | (2006.01) |
| ***A47G 19/02*** | (2006.01) |
| *B65D 1/36* | (2006.01) |
| *B65D 21/02* | (2006.01) |
| *B65D 1/34* | (2006.01) |

(52) U.S. Cl.

CPC ..... *A47G 19/02* (2013.01); *A47G 2400/062* (2013.01); *B65D 1/34* (2013.01); *B65D 1/36* (2013.01); *B65D 21/02* (2013.01)

(58) Field of Classification Search

CPC .... A47G 19/02; A47G 2400/062; B65D 1/34; B65D 1/36; B65D 21/02

USPC .... 220/4.01, 4.26, 4.27, 500, 507, 553, 555, 220/556, 575; 206/503, 504, 505, 515

See application file for complete search history.

(56) References Cited

U.S. PATENT DOCUMENTS

| | | | | |
|---|---|---|---|---|
| 1,520,402 | A * | 12/1924 | Clemans | A47G 19/02 206/0.84 |
| 4,529,464 | A * | 7/1985 | Jones | B29C 51/162 156/244.11 |
| D283,096 | S | 3/1986 | Uhrik | |
| D298,898 | S | 12/1988 | Roshau | |
| D305,846 | S | 2/1990 | Griffith | |
| 5,209,348 | A | 5/1993 | Schafer, III | |
| 5,341,953 | A * | 8/1994 | Forester | A47G 19/02 220/575 |
| 5,676,275 | A | 10/1997 | Khattar | |
| 5,927,538 | A | 7/1999 | Collins | |
| D413,044 | S | 8/1999 | Zappolo | |
| D417,366 | S | 12/1999 | Obra | |
| D426,751 | S | 6/2000 | Obra | |
| D434,276 | S | 11/2000 | Obra | |
| D439,471 | S | 3/2001 | Gee | |
| D618,511 | S | 6/2010 | Lugacy | |
| 8,322,558 | B2 | 12/2012 | Andrews | |
| 8,348,083 | B2 | 1/2013 | Light | |
| 8,616,402 | B2 | 12/2013 | Andrews | |

(Continued)

*Primary Examiner* — Gregory Pickett
*Assistant Examiner* — Elizabeth Volz
(74) *Attorney, Agent, or Firm* — Craig J. Lervick; Larkin Hoffman Daly & Lindgren, Ltd.

(57) ABSTRACT

A cereal bowl according to the present invention includes a basin that may be attached to a base. A partition extends from a sloped floor of the basin to divide the basin into a front interior space and back interior space which can be used to separate a liquid from solid material. The cereal bowl is particularly useful for separating dry breakfast cereal from milk so that the dry breakfast cereal does not absorb milk and become soggy.

18 Claims, 23 Drawing Sheets

(56) References Cited

U.S. PATENT DOCUMENTS

| | | | |
|---|---|---|---|
| 8,883,242 | B1 | 11/2014 | Fischell et al. |
| 8,936,171 | B2 | 1/2015 | Light |

* cited by examiner 10
20
40
22
42

10
12
22
20
14

10
20
30
22
22
42
24

14
40
42
22
20
21

10
20
40
22
22
42

10
20
40
22

10
14
22
42
20

10
12
20
22
42
40

CEREAL BOWL

CLAIM OF PRIORITY

This application claims priority to U.S. Provisional Application No. 62/184,959, filed Jun. 26, 2015, and entitled "The Perfect Cereal Bowl".

FIELD OF THE INVENTION

The present invention relates generally to tableware and, more particularly, to a receptacle for eating breakfast cereal.

BACKGROUND

Breakfast cereals remain a popular food item. Though often eaten as the first meal of the day, breakfast cereals can be enjoyed throughout the day. People can eat breakfast cereal in lieu of a traditional meal or as a between-meal or an after-meal snack. Many a restless sleeper has partaken in the ritual of the late-night bowl of cereal.

Breakfast cereals are typically made from processed grains. They can be eaten hot or cold and are frequently mixed with another food item, such as milk, yogurt and/or fruit. Among the most popular ways to eat breakfast cereal is to mix it with milk. Mixing cereal with milk offers a number of benefits to the consumer, such as improved taste, better texture, additional vitamins and nutrients, hydration and overall enhanced satisfaction.

For many, however, adding milk produces an undesirable side effect—soggy cereal. As consumers of breakfast cereal know well, breakfast cereal begins absorbing milk as soon as the milk is added. As a result, breakfast cereal that has remained immersed in milk for long periods becomes soggy, or mushy.

Consumers have developed various techniques for avoiding the scourge that is soggy breakfast cereal. For example, breakfast cereal lying at or near the bottom of the cereal bowl can be eaten first. Alternatively, milk can be added incrementally to a bowl of cereal as the milk is consumed. Yet another technique is to dispense small portions of breakfast cereal into a bowl. In addition to being a nuisance, however, these techniques may be ineffectual in preventing soggy breakfast cereal.

As a result, specialized cereal bowls have been developed that segregate dry breakfast cereal from milk. Such cereal bowls may contain separate basins or include a partition. A drawback to these designs, however, is that they impede the ability of a consumer to easily combine the breakfast cereal with the milk using a kitchen utensil such as a spoon. A further drawback of these designs is that they impede the stackability of multiple bowls for storage purposes.

Therefore, there is a need for an improved cereal bowl that addresses the aforementioned drawbacks. Specifically, there is a need for a cereal bowl that segregates dry breakfast cereal from milk without adversely interfering with the ability of a consumer to create a mixture of these components with a spoon. There is a further need to be able to stack multiple cereal bowls for storage purposes.

SUMMARY

Embodiments of a receptacle for consuming breakfast cereal with milk of the present invention substantially meet the aforementioned needs. In an embodiment, a cereal bowl has a basin, a base and a partition. The base is adapted to rest on a generally level surface. The basin is adapted to hold food items, such as dry breakfast cereal and milk, and includes a floor generally positioned at an angle with respect to the surface on which the cereal bowl is placed. Basin sidewalls extending upwardly from the floor define an interior space of the cereal bowl. A partition that is positioned on the floor extends, partially or fully, between the basin sidewalls to divide the interior space into two separates spaces, or compartments.

A user can place dry cereal and milk into separate compartments. The receptacle is particularly useful if cereal is place in the upper compartment and milk is placed in the lower compartment, though a consumer can place any number of foods, beverages or other items into the receptacle without departing from the spirit or scope of the present invention. The partition maintains the contents of the compartments generally separated. A user can utilize a spoon to extract a desired portion of cereal from the upper compartment and wholly or partially immerse the extracted portion into the contents of the lower compartment. Due to the dimensions and configuration of the cereal bowl, the user can maintain the spoon in close proximity to the basin sidewalls when moving the contents of the upper compartment into the lower compartment. This helps prevent cereal from falling off the spoon into the lower compartment.

DESCRIPTION OF THE PREFERRED EMBODIMENTS

Figure 1A:
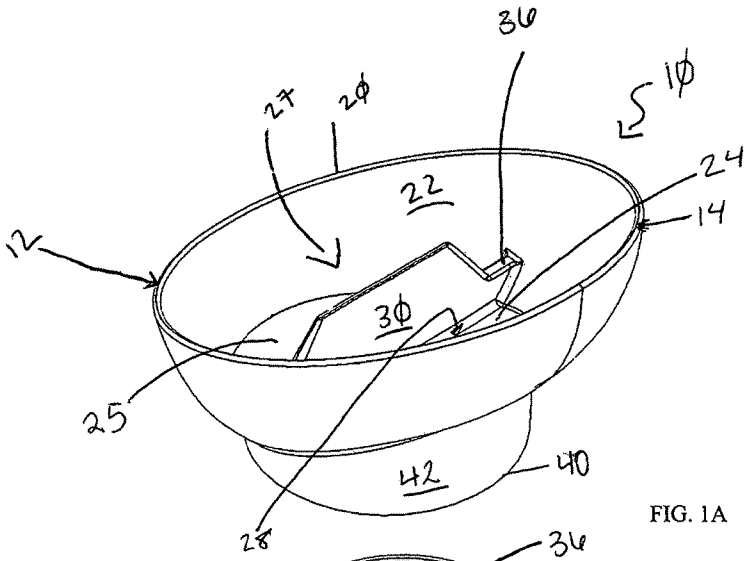
FIG. 1A is a top perspective view of a cereal bowl according to an embodiment of the present invention.
Figure 1B:
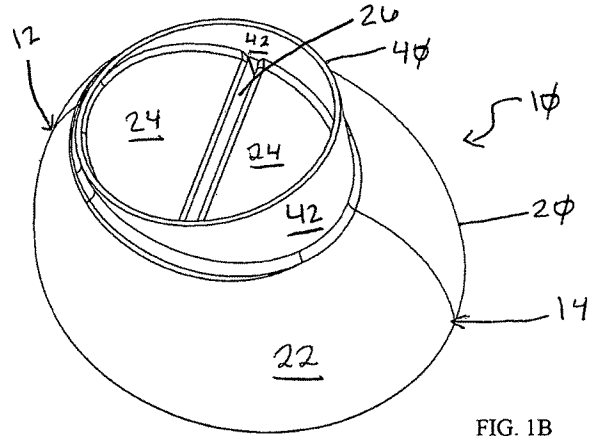
FIG. 1B is a bottom perspective view of the cereal bowl illustrated in FIG. 1A.
Figure 1C:
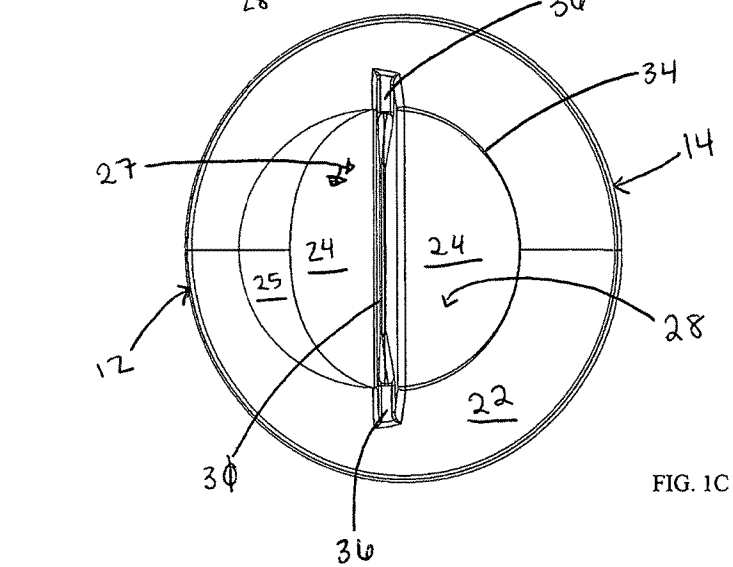
FIG. 1C is a top plan view of the cereal bowl illustrated in FIG. 1A.
Figure 1D:
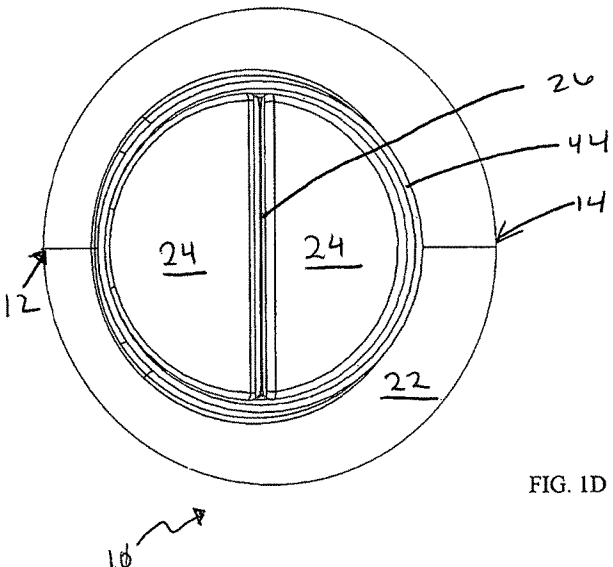
FIG. 1D is a bottom plan view of the cereal bowl illustrated in FIG. 1A.
Figures 1E, 1F, 1G, 1H:
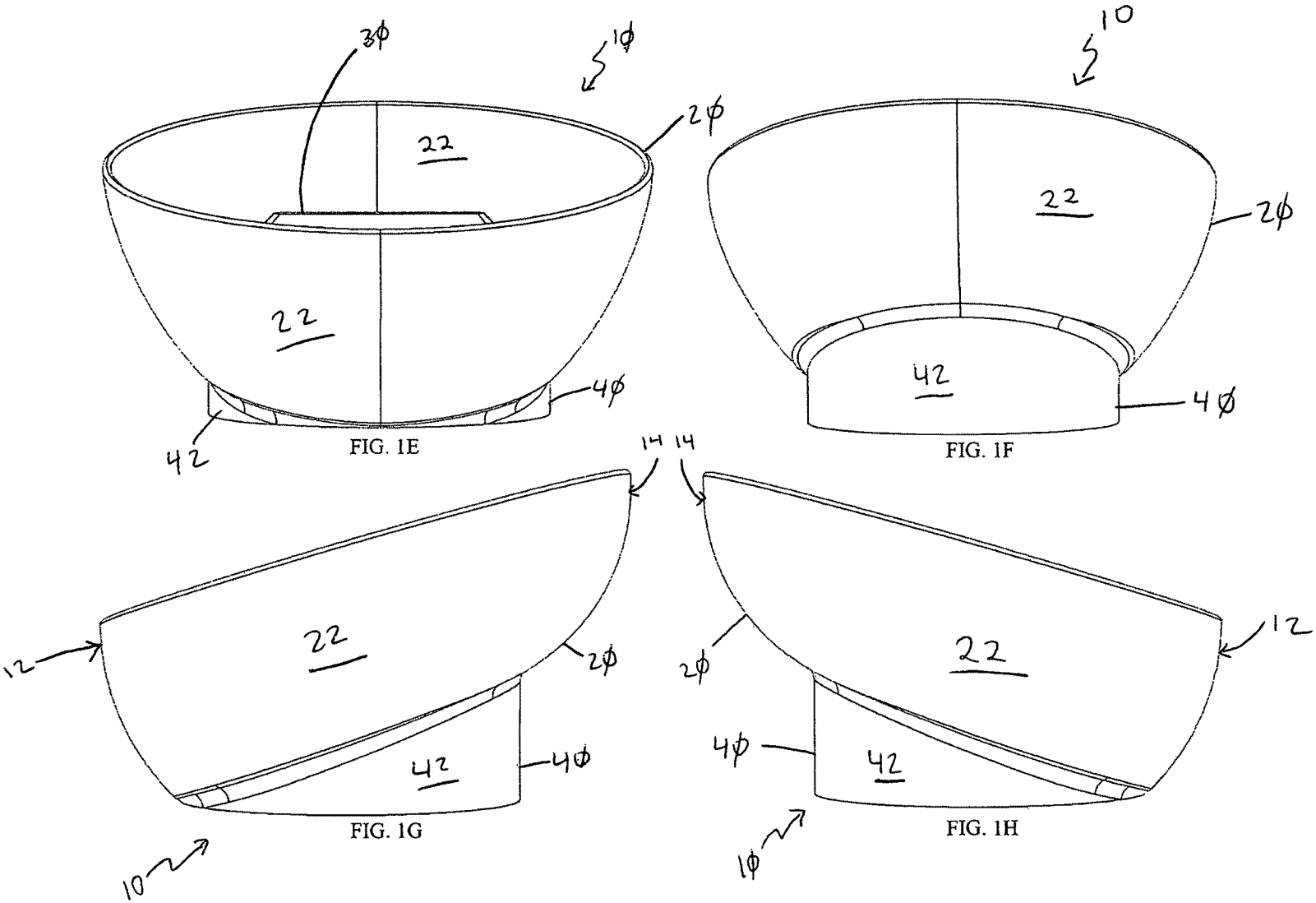
FIG. 1E is a front elevation view of the cereal bowl illustrated in FIG. 1A.
FIG. 1F is a rear view elevation view of the cereal bowl illustrated in FIG. 1A.
FIG. 1G is a right side elevation view of the cereal bowl illustrated in FIG. 1A.
FIG. 1H is a left side elevation view of the cereal bowl illustrated in FIG. 1A.

A bowl 10 is depicted generally in FIGS. 1-11. Although bowl 10 can be used for any number of purposes, the illustrated embodiments are especially suited for consuming breakfast cereal. Bowl 10 is particularly useful for separating dry breakfast cereal from milk until a user wishes to the combine an amount of the dry breakfast cereal with milk.

As shown in FIGS. 1-8, bowl 10 includes basin 20 and partition 30. In embodiments, bowl 10 may also include base 40. Bowl 10 has front end 12 and back end 14, though one skilled in the art will recognize that bowl 10 may be a shape that does not have discernable front and back ends.

Referring to FIGS. 1-8, basin 20 includes basin sidewalls 22 and floor 24. Basin 20 may also include transition surface 25. Within basin 20 and separated by partition 30 are front interior space (or compartment) 27 and back interior space (or compartment) 28. Basin sidewalls 22 and floor 24, as well as transition surface 25 (if present), form a substantially continuous inner surface of basin 20. Basin sidewalls 22 extend generally upwardly from floor 24 such that basin 20 forms a receptacle adapted to receive food or drink, such breakfast cereal or milk. In an embodiment, basin sidewalls 22 are parabolically shaped such that basin 20 forms a concave receptacle. Transition surface 25 may be positioned between basin sidewall 22 and floor 24 at front end 12 of bowl 10. Arranged a different angle, transition surface 25 creates an area or zone that is adapted to facilitate the use of a spoon to extract liquid that pools in transition surface 25. Basin 20 may include indicia to assist a user in dispensing controlled amount of milk and/or breakfast cereal in bowl 10. For example, front interior space 27 may include a marking corresponding to a service size or desired volume of milk.

When basin 20 is placed on a level support surface, floor 24 is generally sloped in relation to the support surface. Referring to FIGS. 1A-3A and 4A-8A, for example, floor 24 slopes upward from front end 12 of bowl 10 to back end 14 of bowl 10. Floor 24 generally forms an angle of between approximately ten degrees (10°) and seventy degrees (70°). In an embodiment, floor 24 forms an angle of approximately forty degrees (40°). Floor 24 may include cavity 26, as shown in FIGS. 1B-3B and 5B-8B. Cavity 26 may extend upwardly into partition 30 and be adapted to receive a portion of partition 30 from another bowl 10 such that two or more bowls 10 can be stacked, or nested, as shown in FIGS. 3A-3H and 4. Cavity 26 may also be adapted to receive partition 30 fitted with removable and interchangeable caps (as described below).

Extending upwardly from floor 24 is partition 30. Partition 30 is generally perpendicular in relation to the support surface that supports basin 20. In this manner, partition 30 and floor 24 would form an angle that is less than ninety degrees (90°). Partition 30 may extend across the entirety of floor 24 between two locations of basin sidewalls 22, as shown in FIGS. 1-3 and 6-8. Alternatively, partition 30 may extend only partially across floor 24, as shown in FIG. 5. Partition 30 generally separates front interior space (or compartment) 27 from rear interior space (or compartment) 28.

Figure 2A:
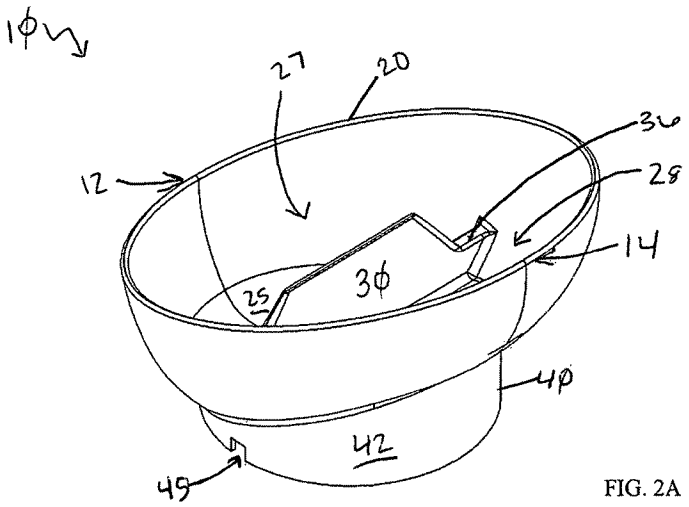
FIG. 2A is a top perspective view of a cereal bowl according to an embodiment of the present invention.
Figure 2B:
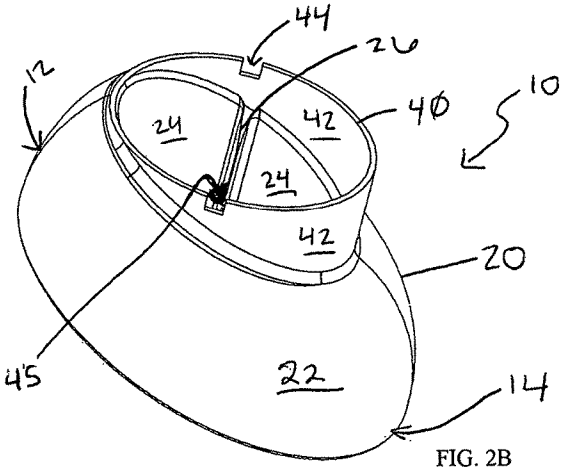
FIG. 2B is a bottom perspective view of the cereal bowl illustrated in FIG. 2A.
Figure 2C:
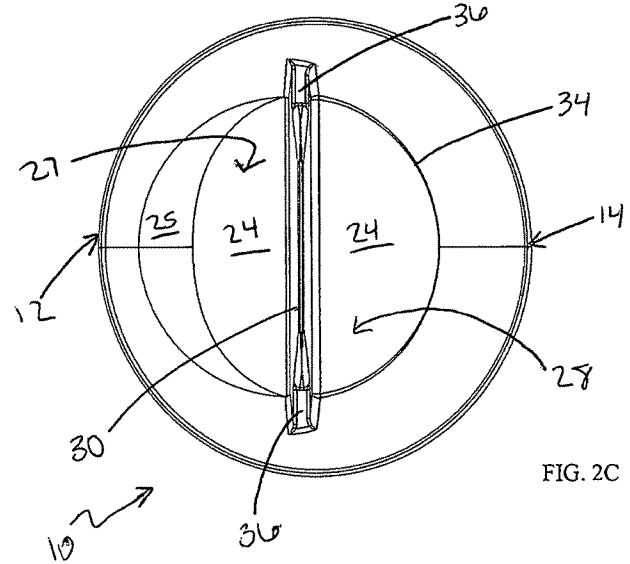
FIG. 2C is a top plan view of the cereal bowl illustrated in FIG. 2A.
Figure 2D:
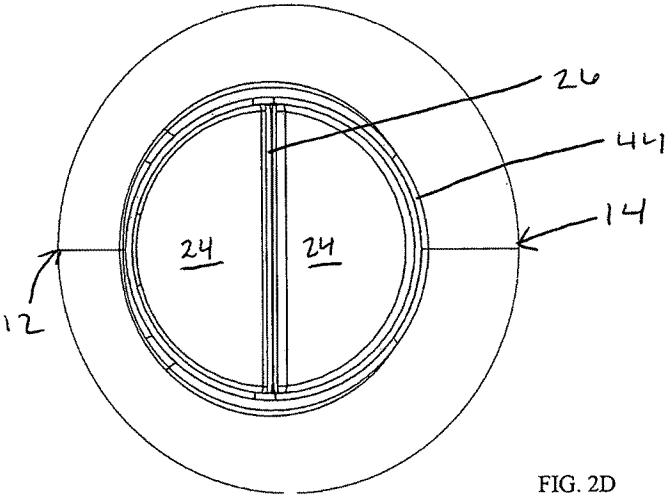
FIG. 2D is a bottom plan view of the cereal bowl illustrated in FIG. 2A.
Figures 2E, 2F, 2G, 2H:
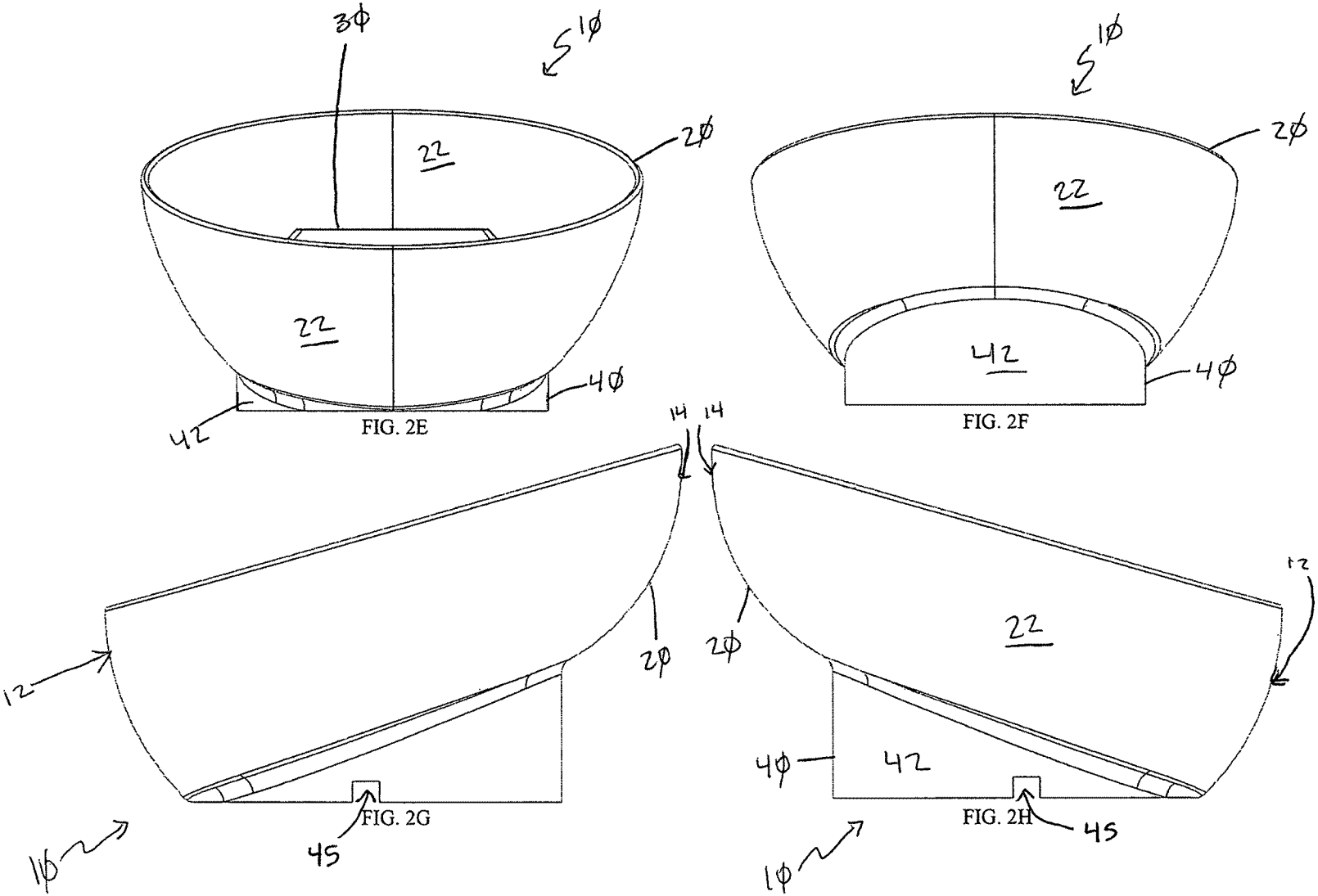
FIG. 2E is a front elevation view of the cereal bowl illustrated in FIG. 2A.
FIG. 2F is a rear view elevation view of the cereal bowl illustrated in FIG. 2A.
FIG. 2G is a right side elevation view of the cereal bowl illustrated in FIG. 2A.
FIG. 2H is a left side elevation view of the cereal bowl illustrated in FIG. 2A.
Figure 3B:
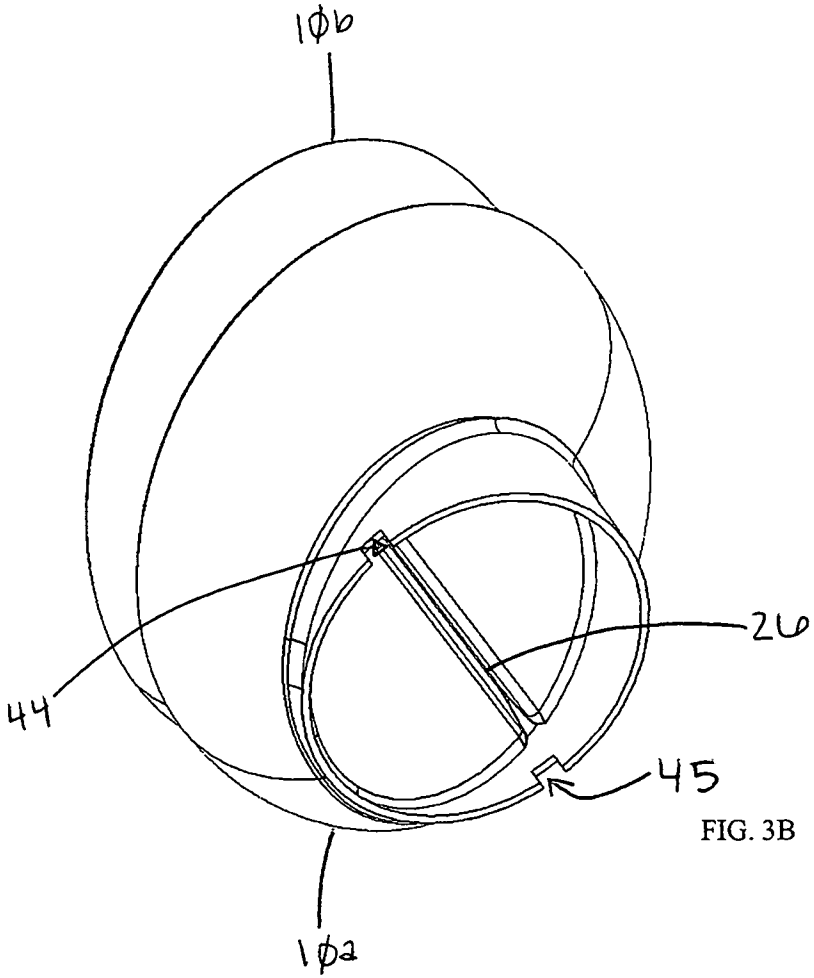
FIG. 3B is a bottom perspective view of the stacked cereal bowls illustrated in FIG. 3A.
Figure 3A:
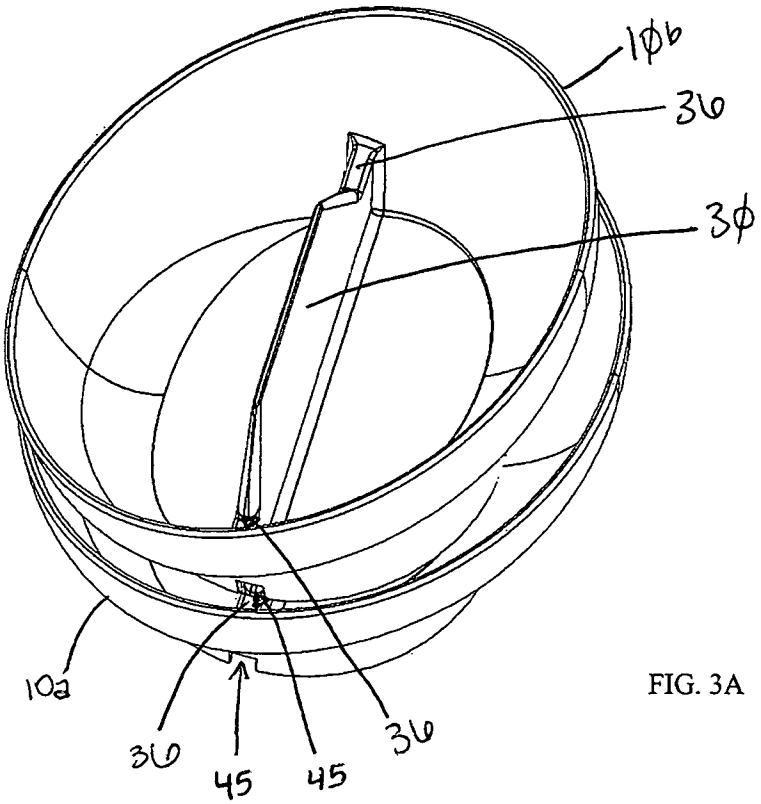
FIG. 3A is a top perspective view of cereal bowls that are stacked according to an embodiment of the present invention.
Figure 3D:
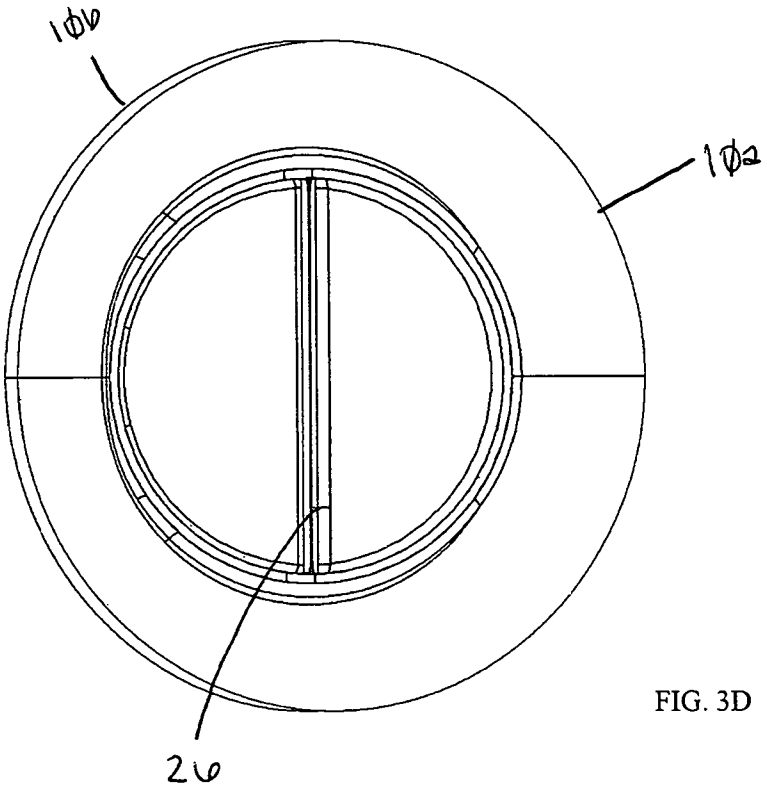
FIG. 3D is a bottom plan view of the stacked cereal bowls illustrated in FIG. 3A.
Figure 3C:
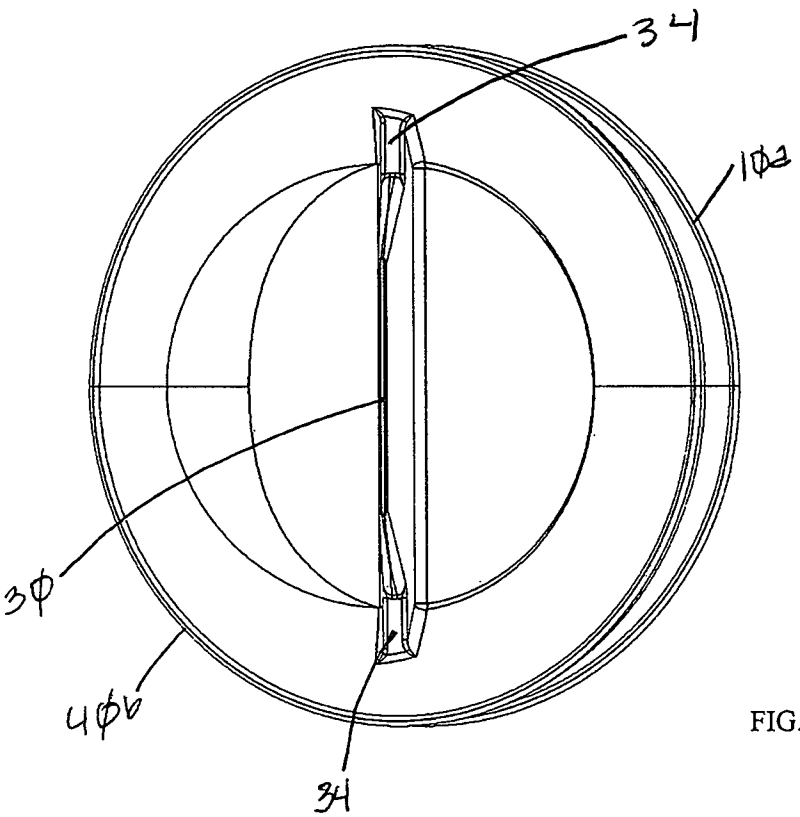
FIG. 3C is a top plan view of the stacked cereal bowls illustrated in FIG. 3A.
Figure 3F:
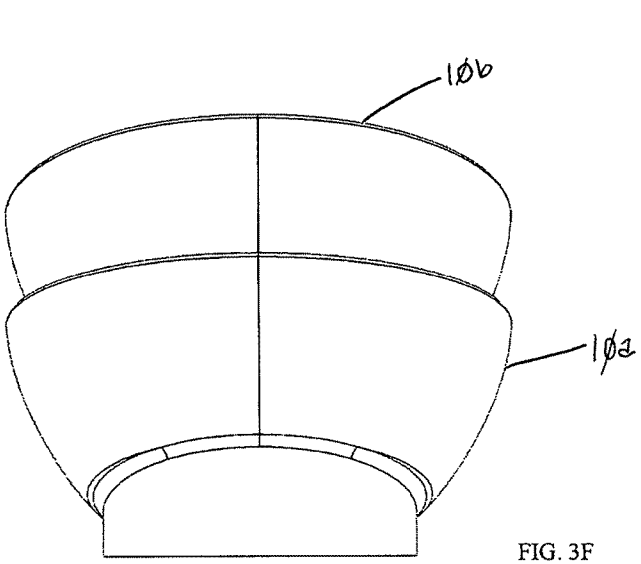
FIG. 3F is a rear view elevation view of the stacked cereal bowls illustrated in FIG. 3A.
Figure 3H:
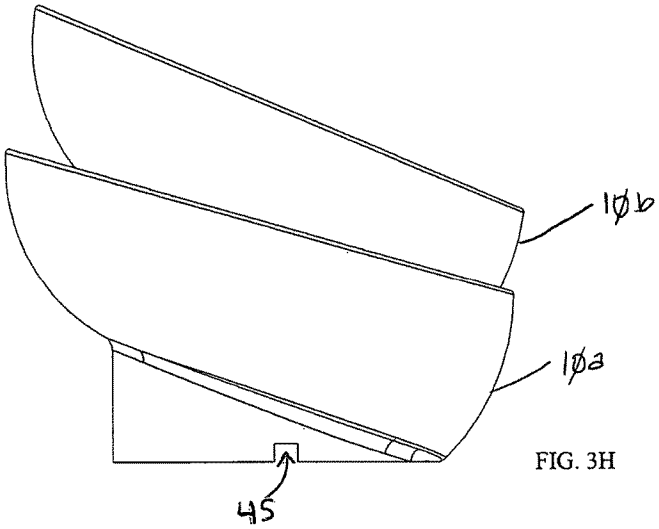
FIG. 3H is a left side elevation view of the stacked cereal bowls illustrated in FIG. 3A.
Figure 3E:
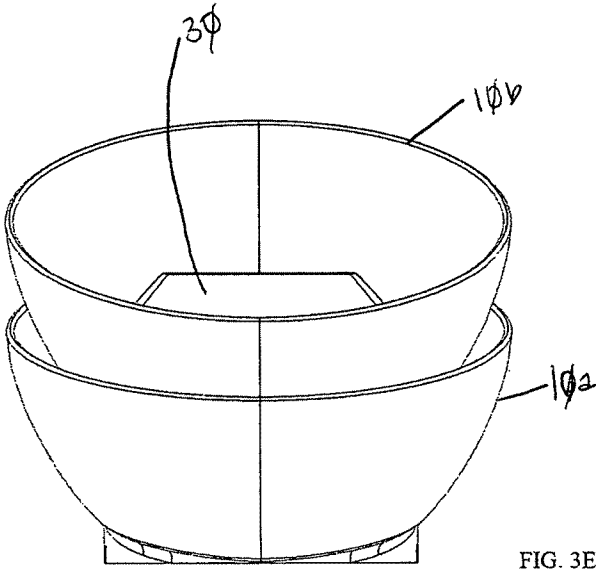
FIG. 3E is a front elevation view of the stacked cereal bowls illustrated in FIG. 3A.
Figure 3G:
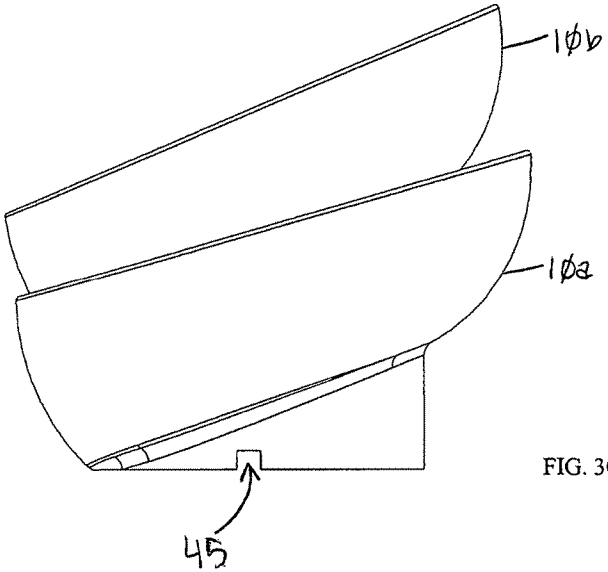
FIG. 3G is a right side elevation view of the stacked cereal bowls illustrated in FIG. 3A.
Figure 5B:
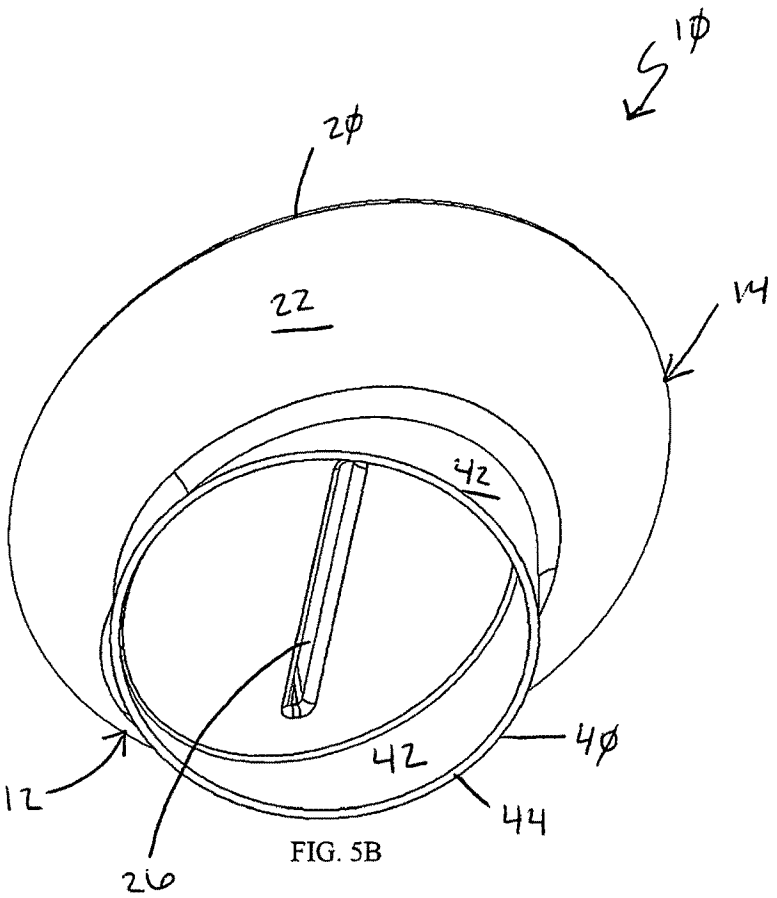
FIG. 5B is a bottom perspective view of the cereal bowl illustrated in FIG. 5A.
Figure 5A:
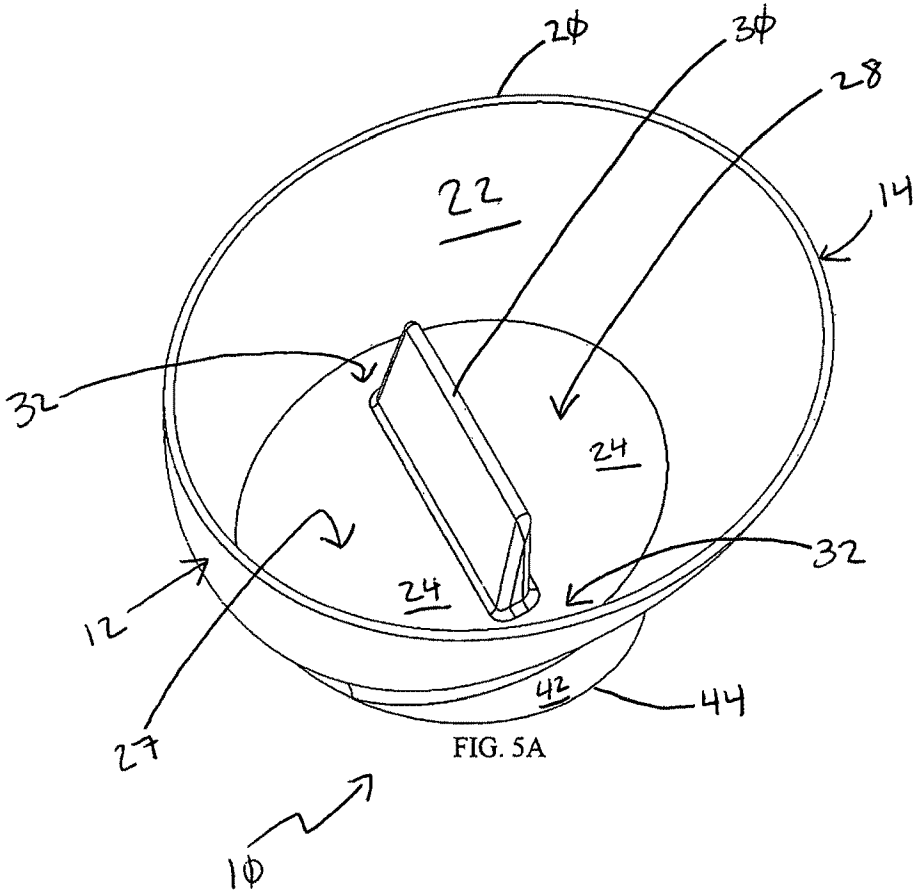
FIG. 5A is a top perspective view of a cereal bowl according to an embodiment of the present invention.
Figure 5D:
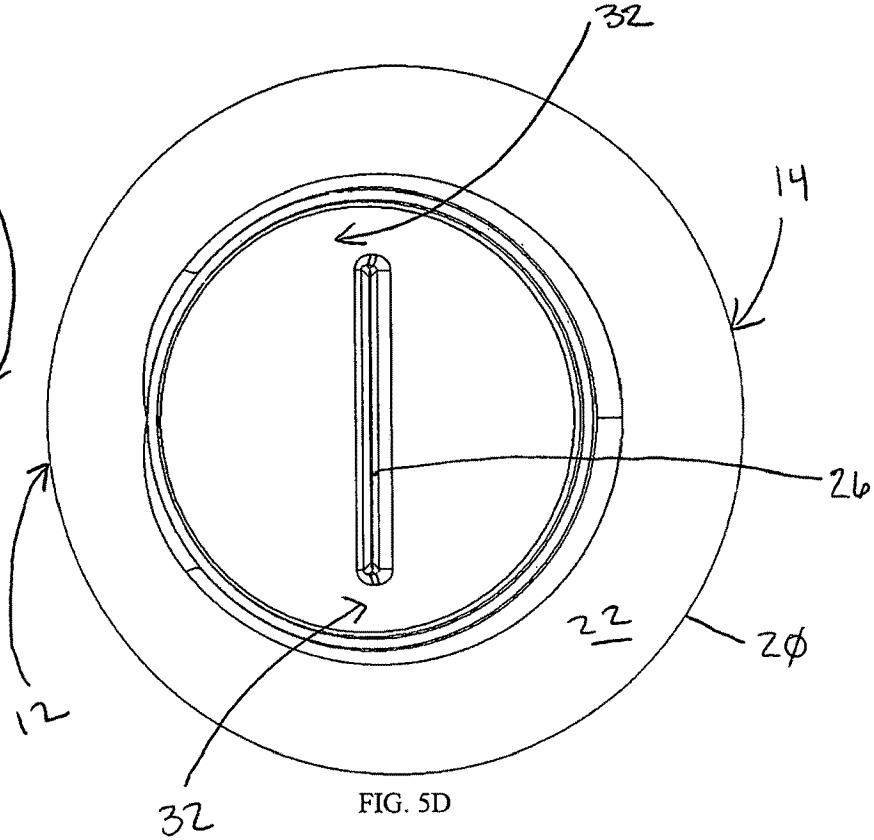
FIG. 5D is a bottom plan view of the cereal bowl illustrated in FIG. 5A.
Figure 5C:
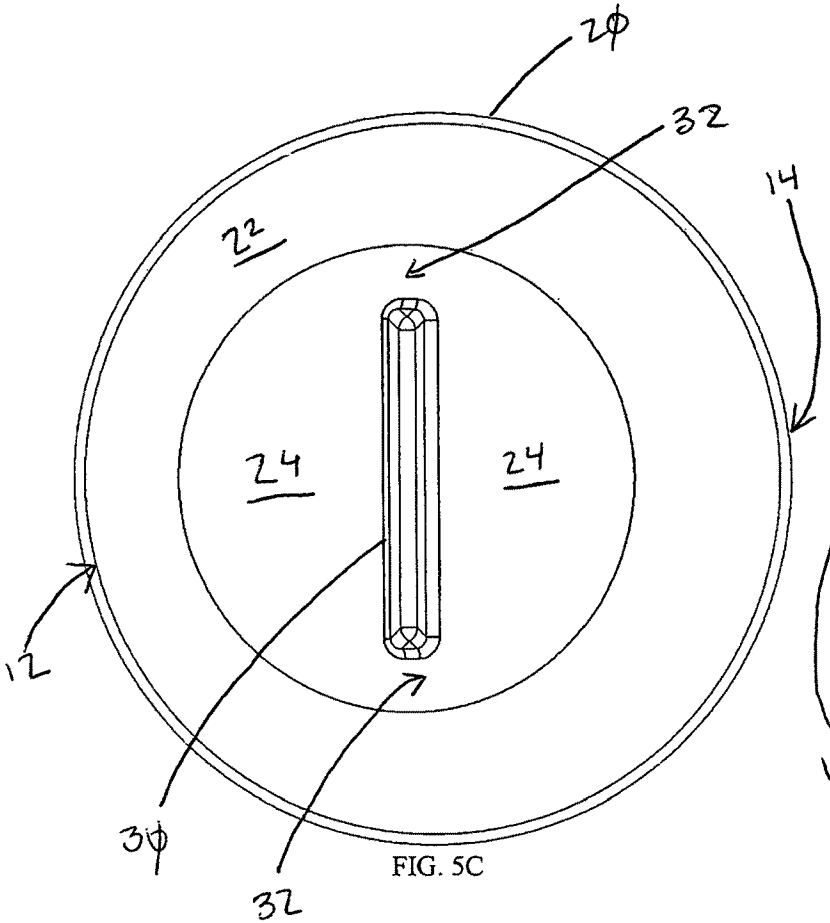
FIG. 5C is a top plan view of the cereal bowl illustrated in FIG. 5A.
Figure 5F:
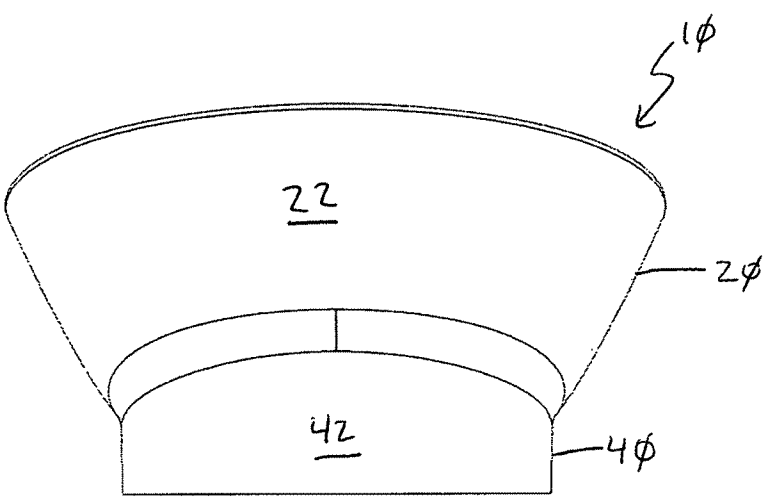
FIG. 5F is a rear view elevation view of the cereal bowl illustrated in FIG. 5A.
Figure 5H:
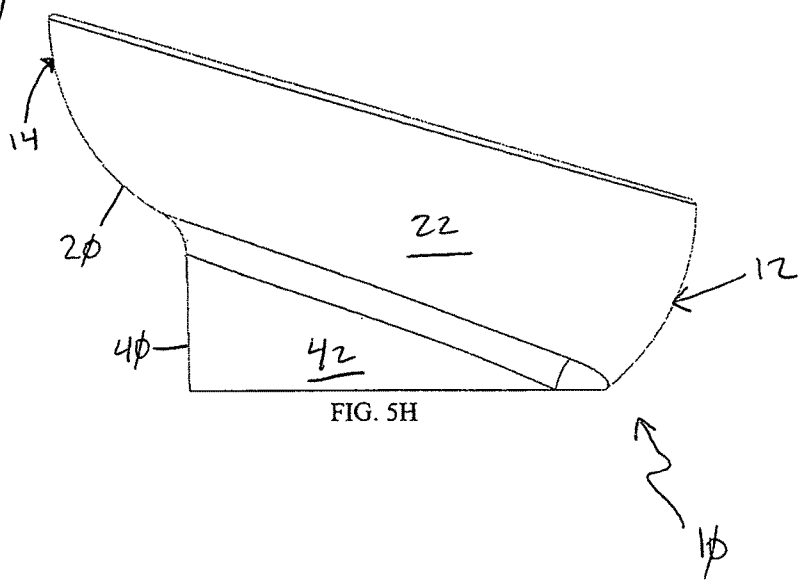
FIG. 5H is a left side elevation view of the cereal bowl illustrated in FIG. 5A.
Figure 5E:
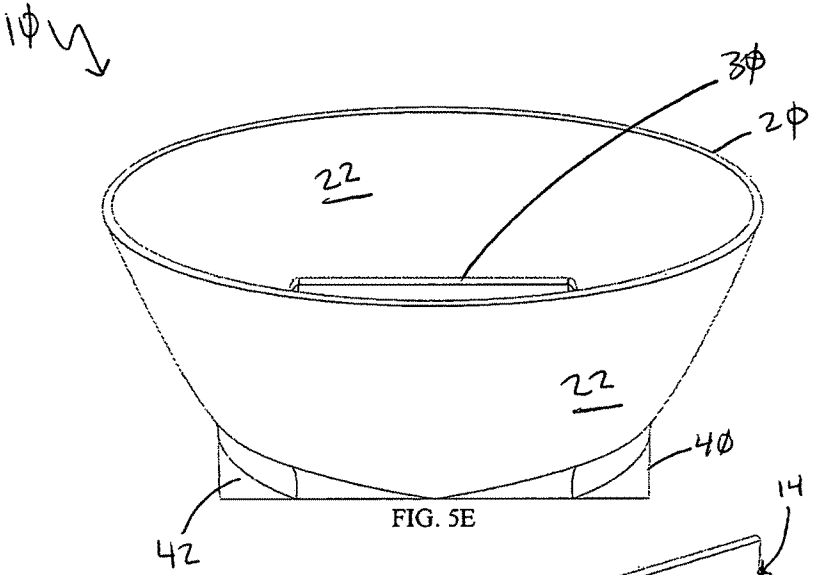
FIG. 5E is a front elevation view of the cereal bowl illustrated in FIG. 5A.
Figure 5G:
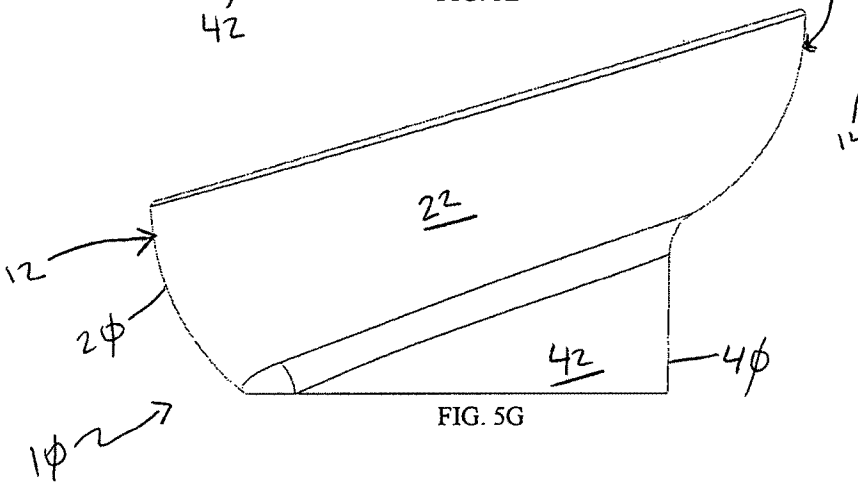
FIG. 5G is a right side elevation view of the cereal bowl illustrated in FIG. 5A.
Figure 6B:
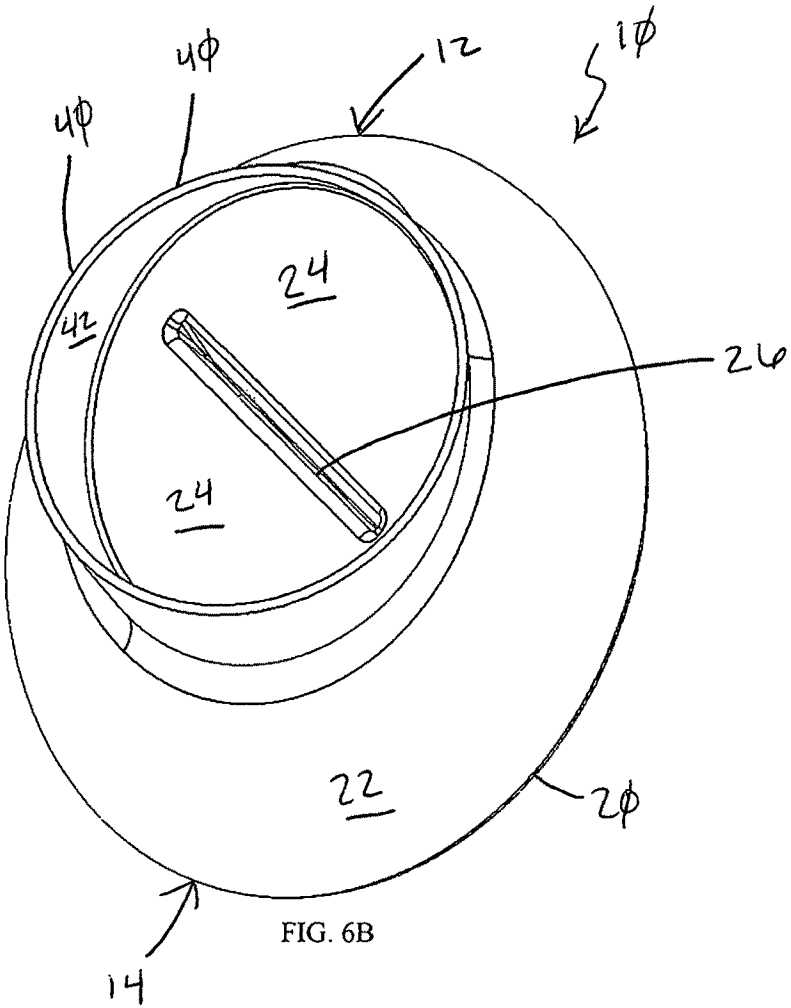
FIG. 6B is a bottom perspective view of the cereal bowl illustrated in FIG. 6A.
Figure 6A:
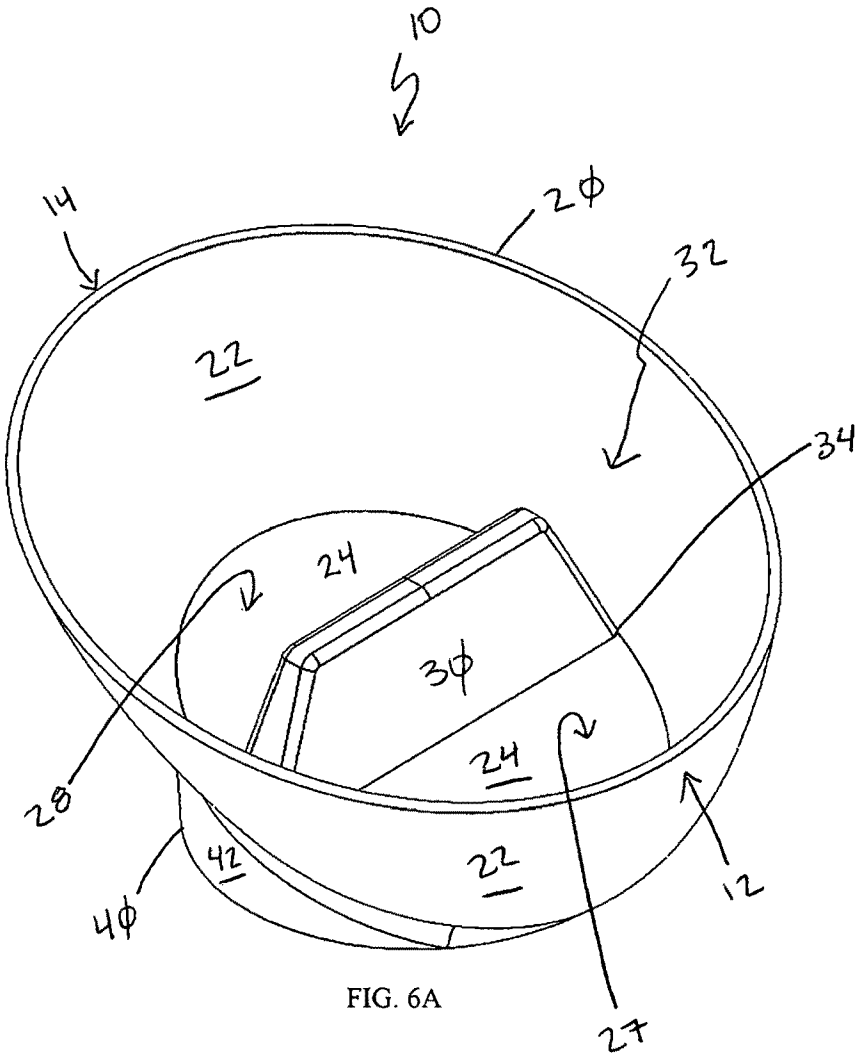
FIG. 6A is a top perspective view of a cereal bowl according to an embodiment of the present invention.
Figure 6D:
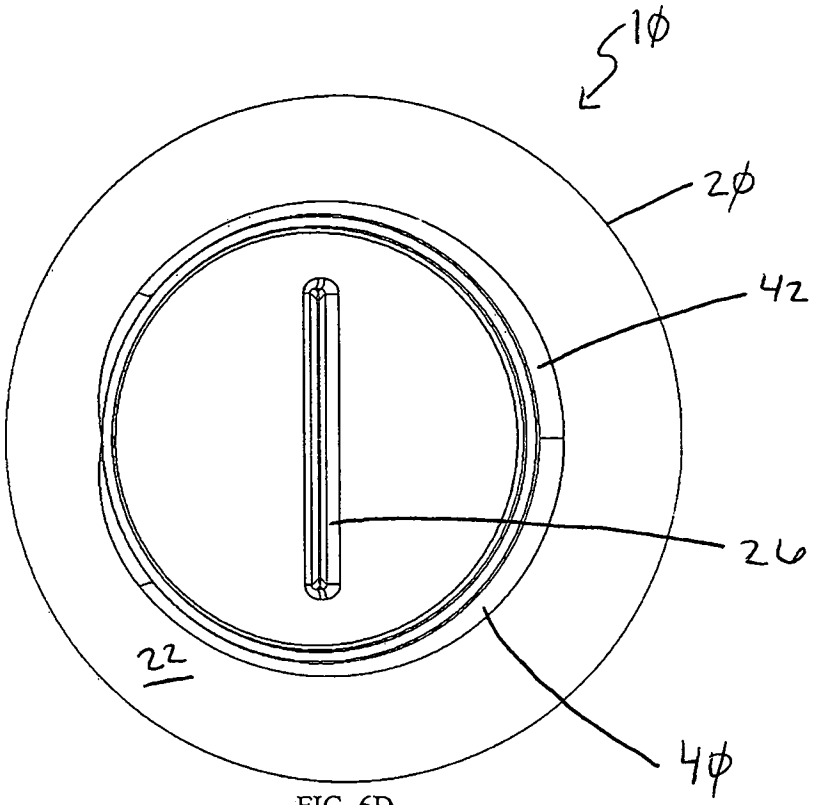
FIG. 6D is a bottom plan view of the cereal bowl illustrated in FIG. 6A.
Figure 6C:
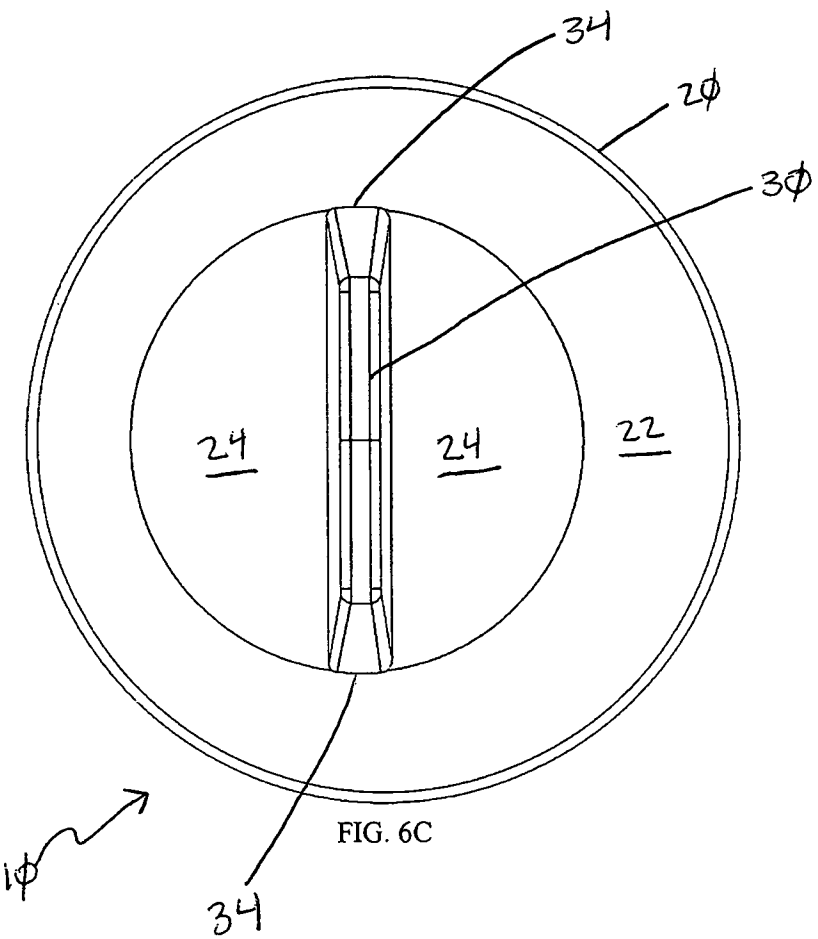
FIG. 6C is a top plan view of the cereal bowl illustrated in FIG. 6A.
Figures 6E, 6F, 6G, 6H:
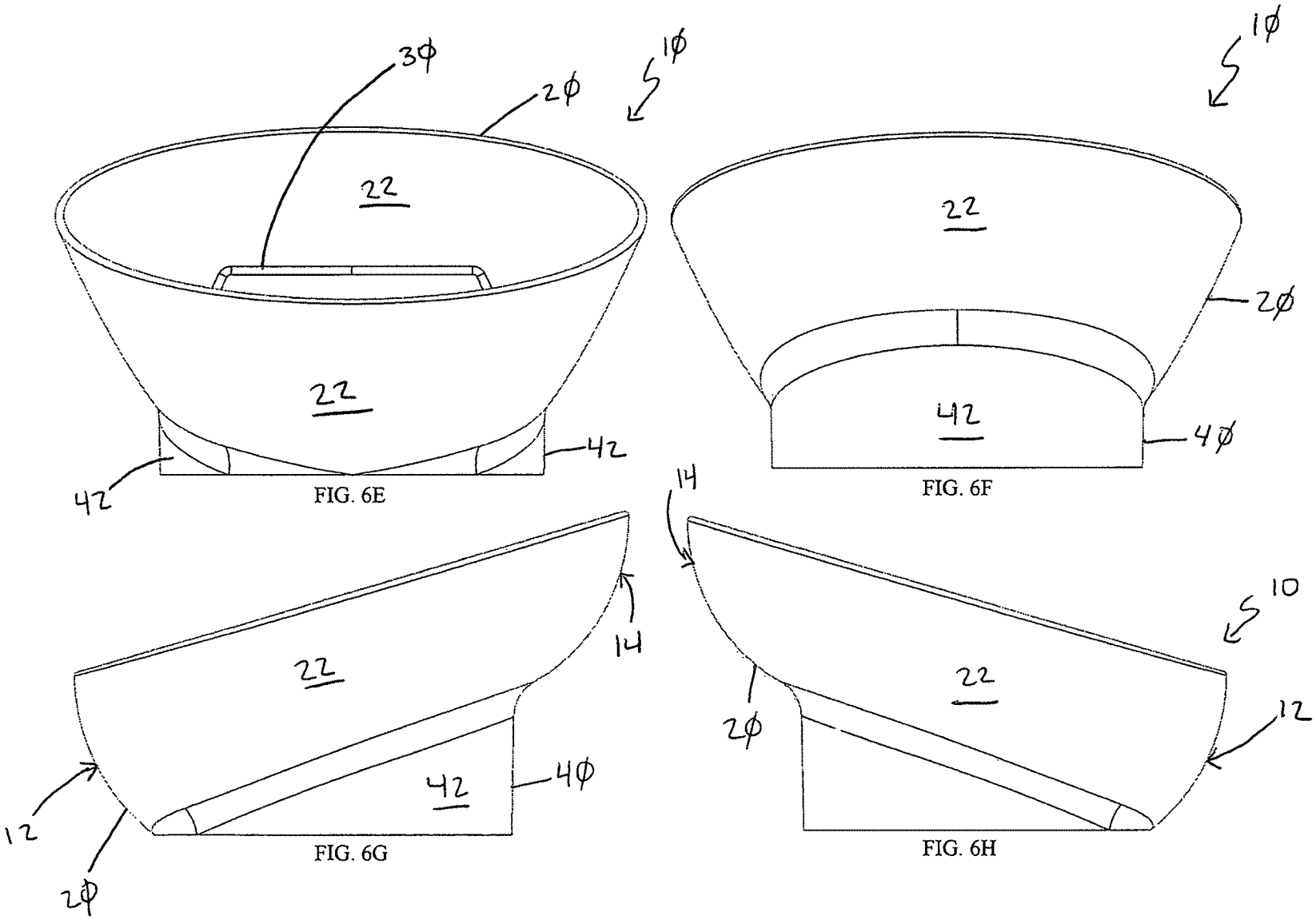
FIG. 6E is a front elevation view of the cereal bowl illustrated in FIG. 6A.
FIG. 6F is a rear view elevation view of the cereal bowl illustrated in FIG. 6A.
FIG. 6G is a right side elevation view of the cereal bowl illustrated in FIG. 6A.
FIG. 6H is a left side elevation view of the cereal bowl illustrated in FIG. 6A.
Figure 7B:
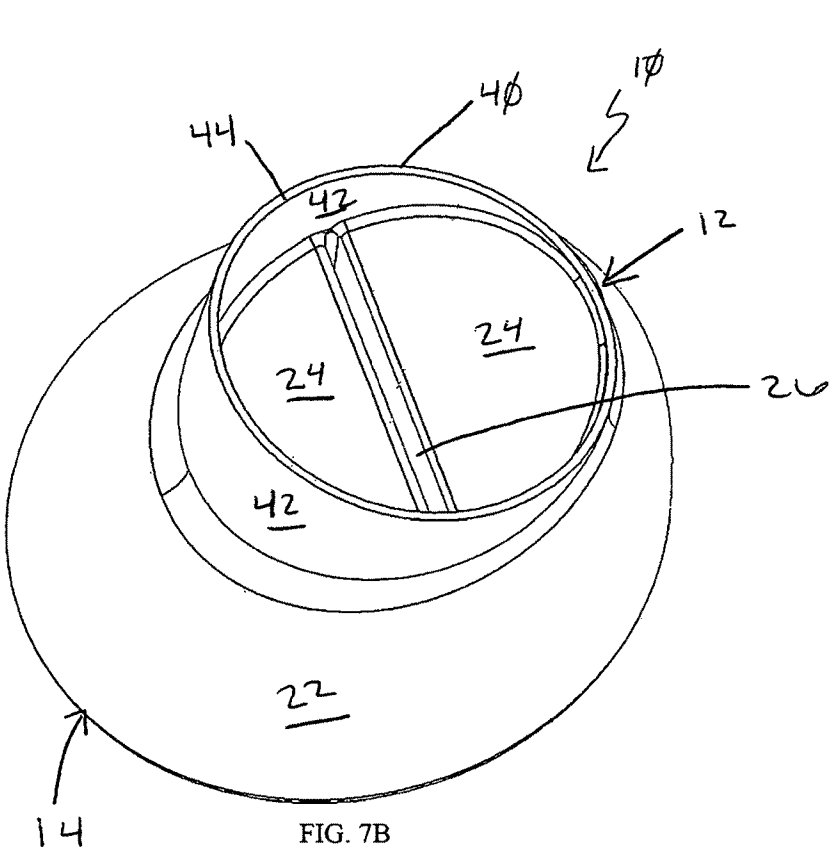
FIG. 7B is a bottom perspective view of the cereal bowl illustrated in FIG. 7A.
Figure 7A:
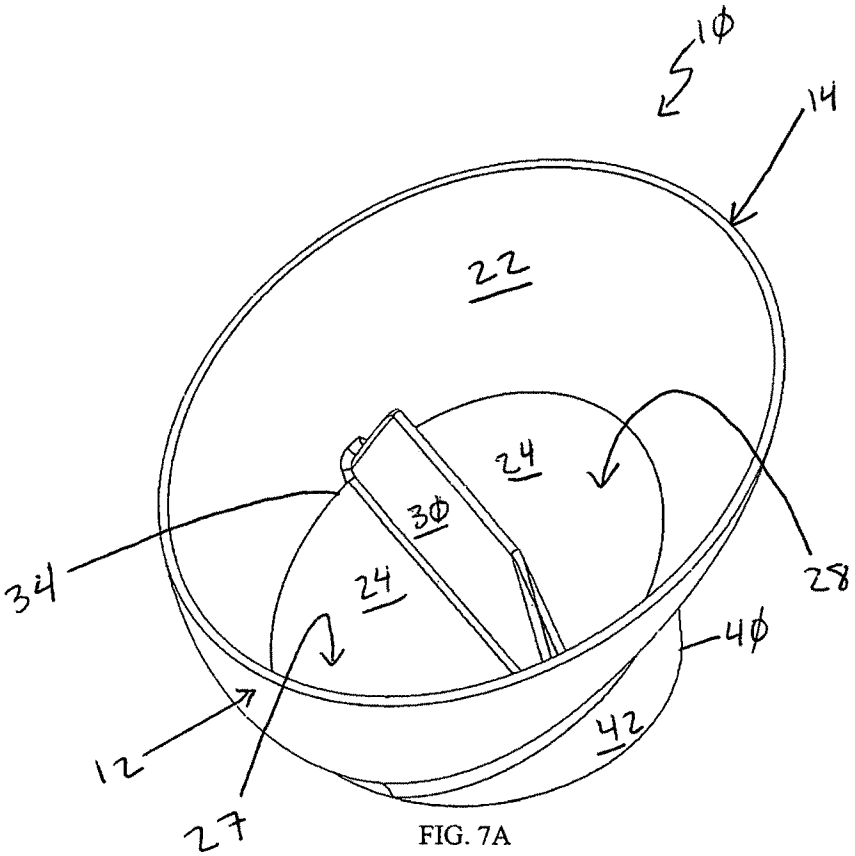
FIG. 7A is a top perspective view of a cereal bowl according to an embodiment of the present invention.
Figure 7D:
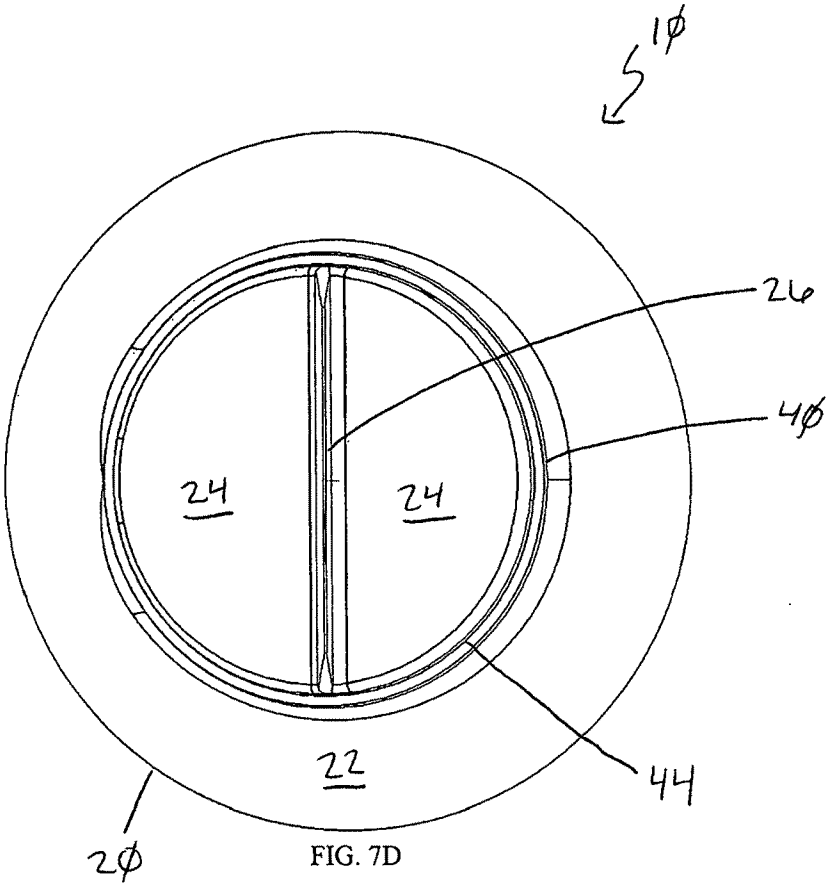
FIG. 7D is a bottom plan view of the cereal bowl illustrated in FIG. 7A.
Figure 7C:
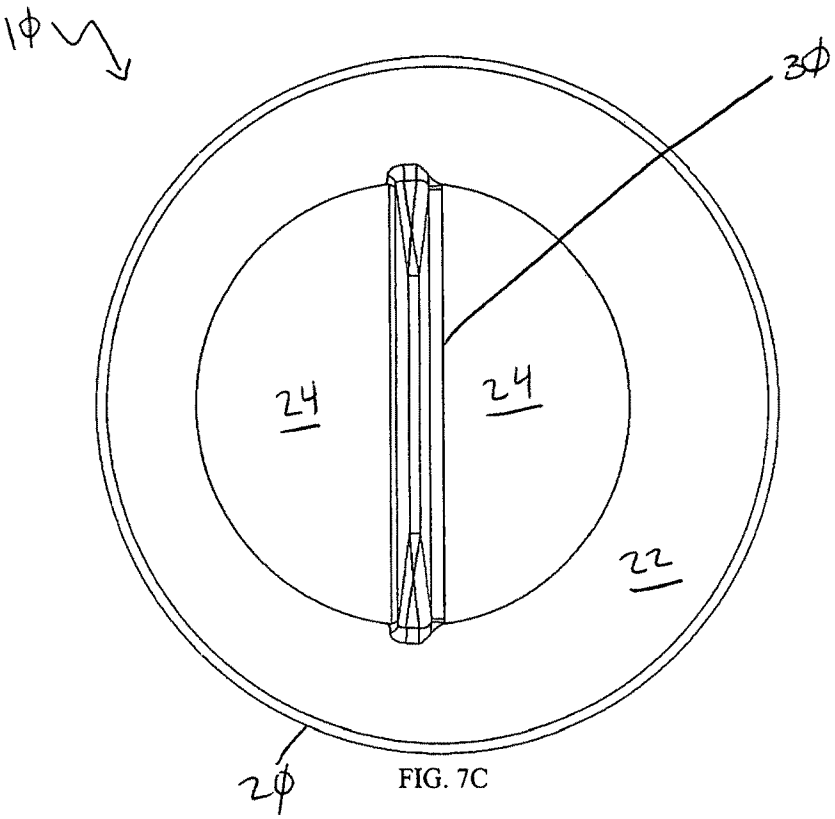
FIG. 7C is a top plan view of the cereal bowl illustrated in FIG. 7A.
Figure 7F:
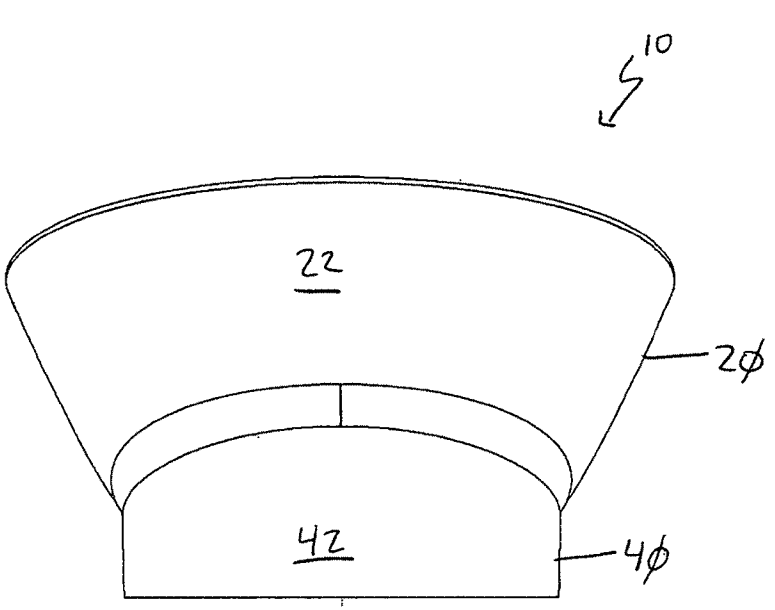
FIG. 7F is a rear view elevation view of the cereal bowl illustrated in FIG. 7A.
Figure 7E:
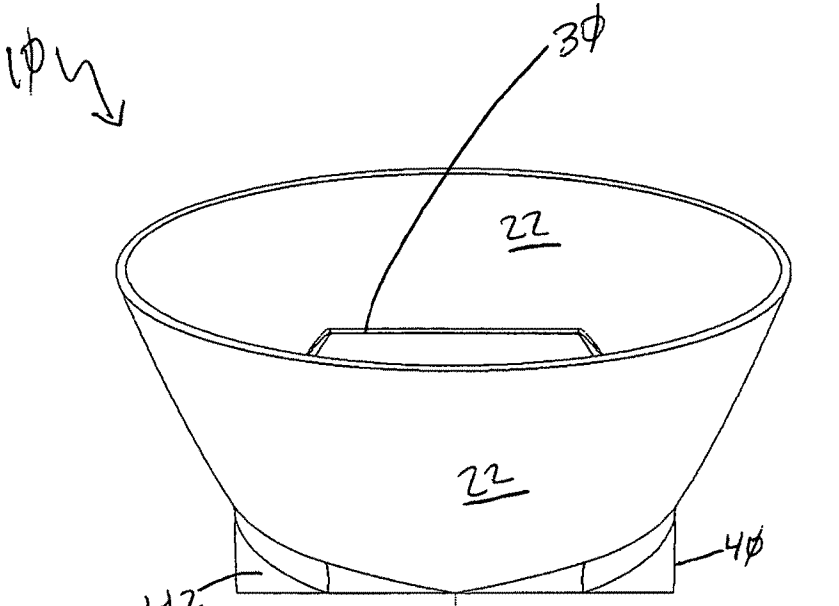
FIG. 7E is a front elevation view of the cereal bowl illustrated in FIG. 7A.
Figure 7H:
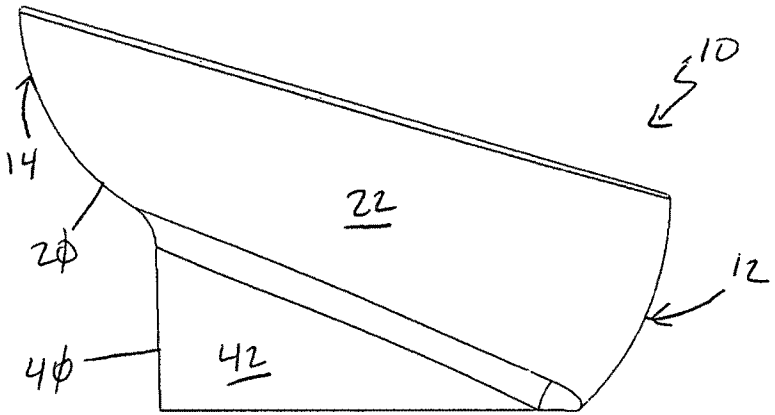
FIG. 7H is a left side elevation view of the cereal bowl illustrated in FIG. 7A.
Figure 7G:
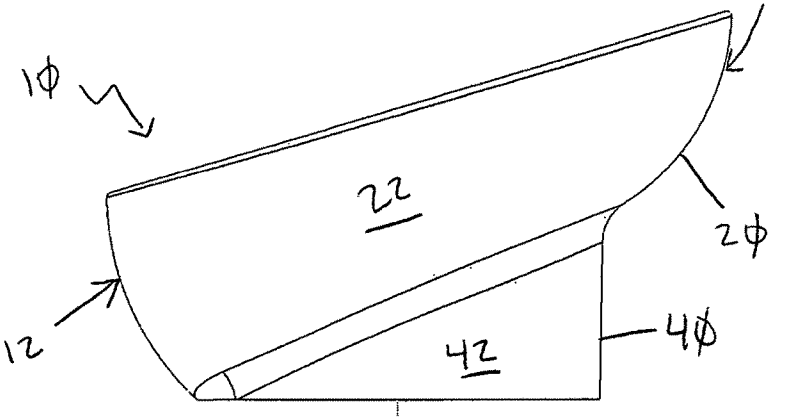
FIG. 7G is a right side elevation view of the cereal bowl illustrated in FIG. 7A.
Figure 8B:
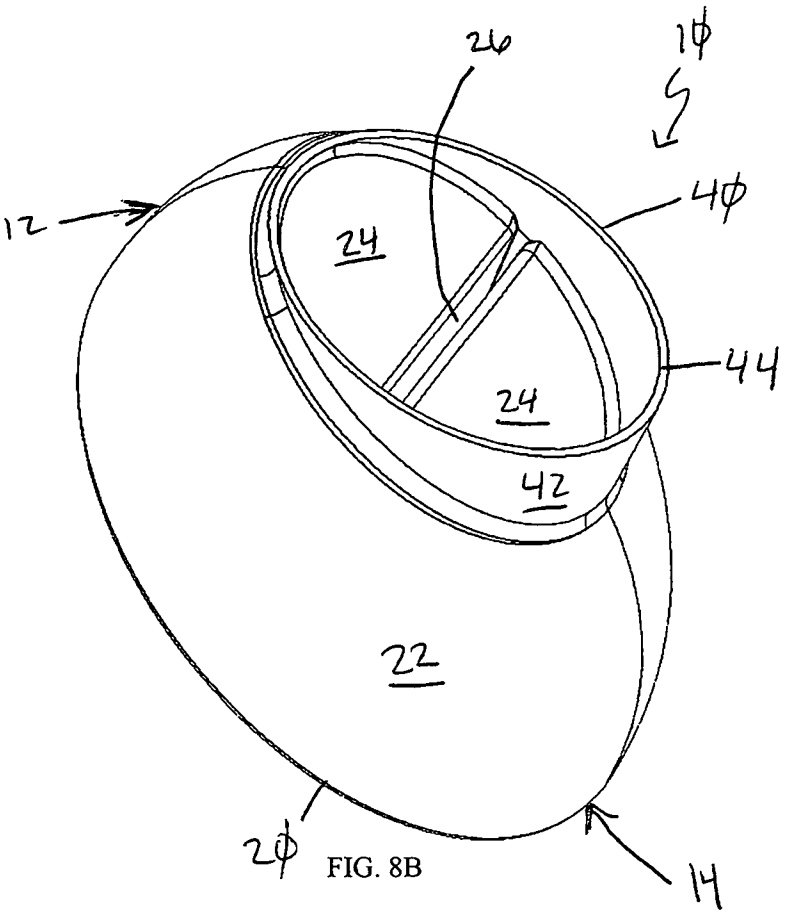
FIG. 8B is a bottom perspective view of the cereal bowl illustrated in FIG. 8A.
Figure 8A:
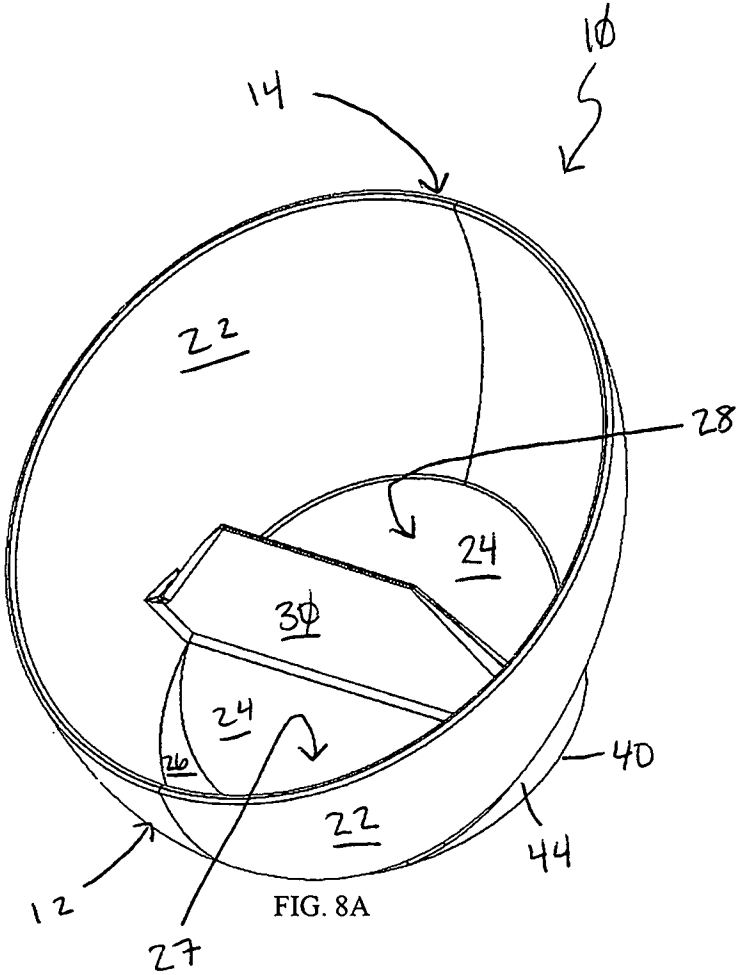
FIG. 8A is a top perspective view of a cereal bowl according to an embodiment of the present invention.
Figure 8D:
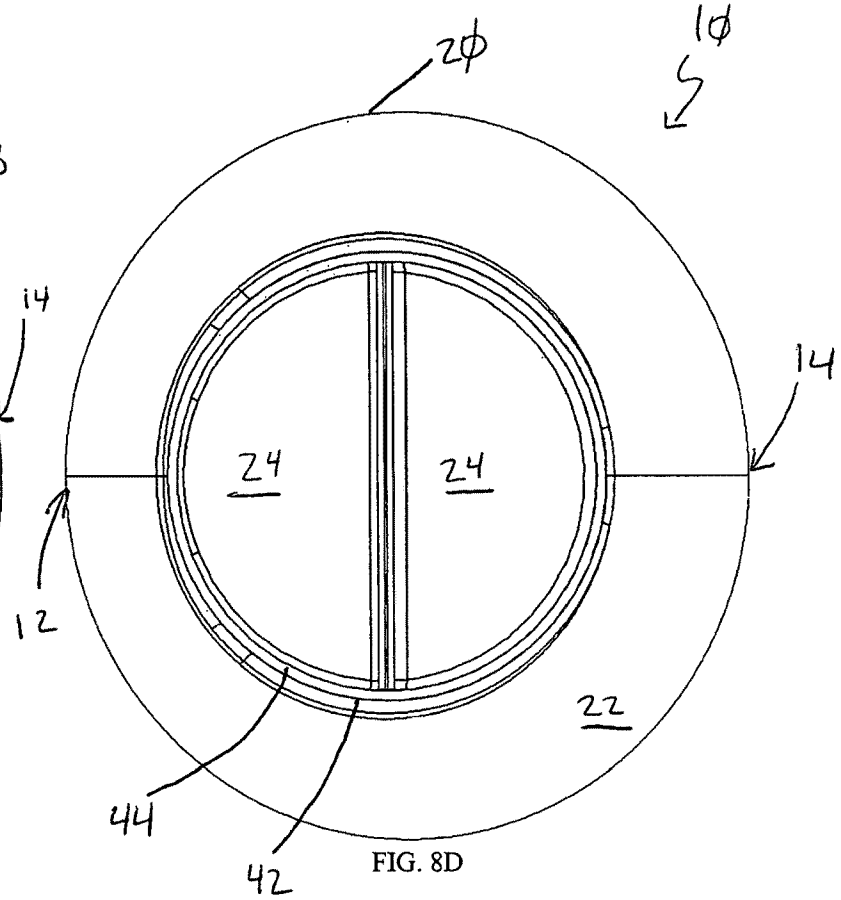
FIG. 8D is a bottom plan view of the cereal bowl illustrated in FIG. 8A.
Figure 8C:
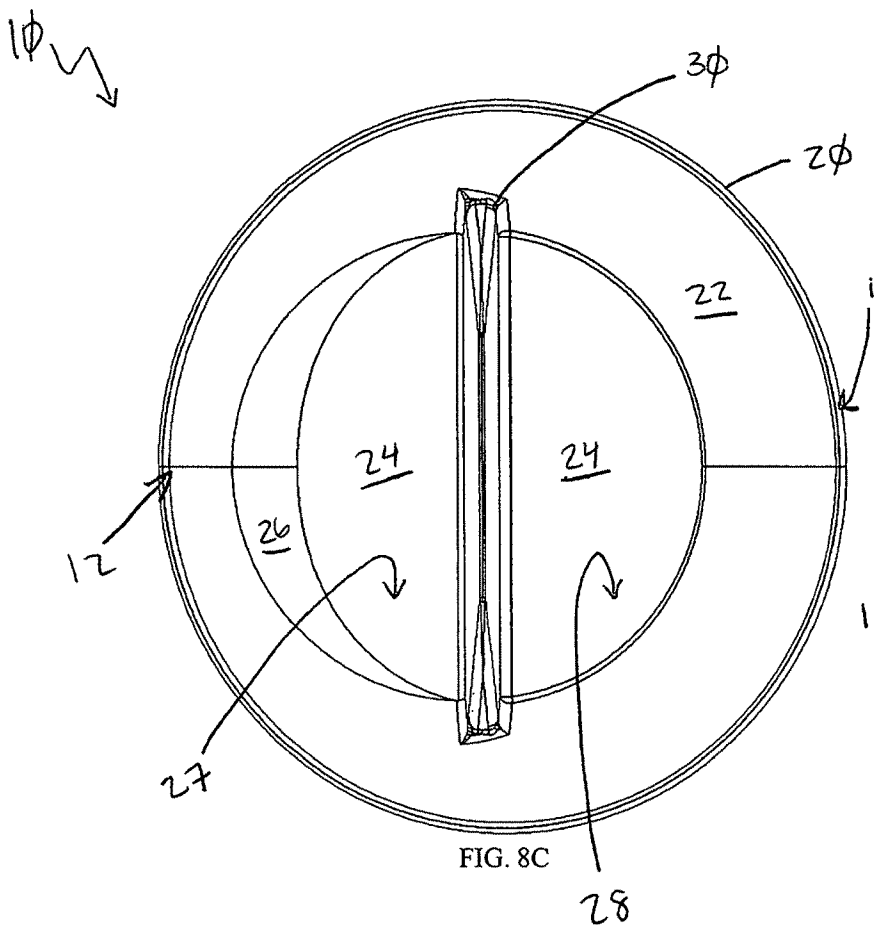
FIG. 8C is a top plan view of the cereal bowl illustrated in FIG. 8A.
Figures 8E, 8F, 8G, 8H:
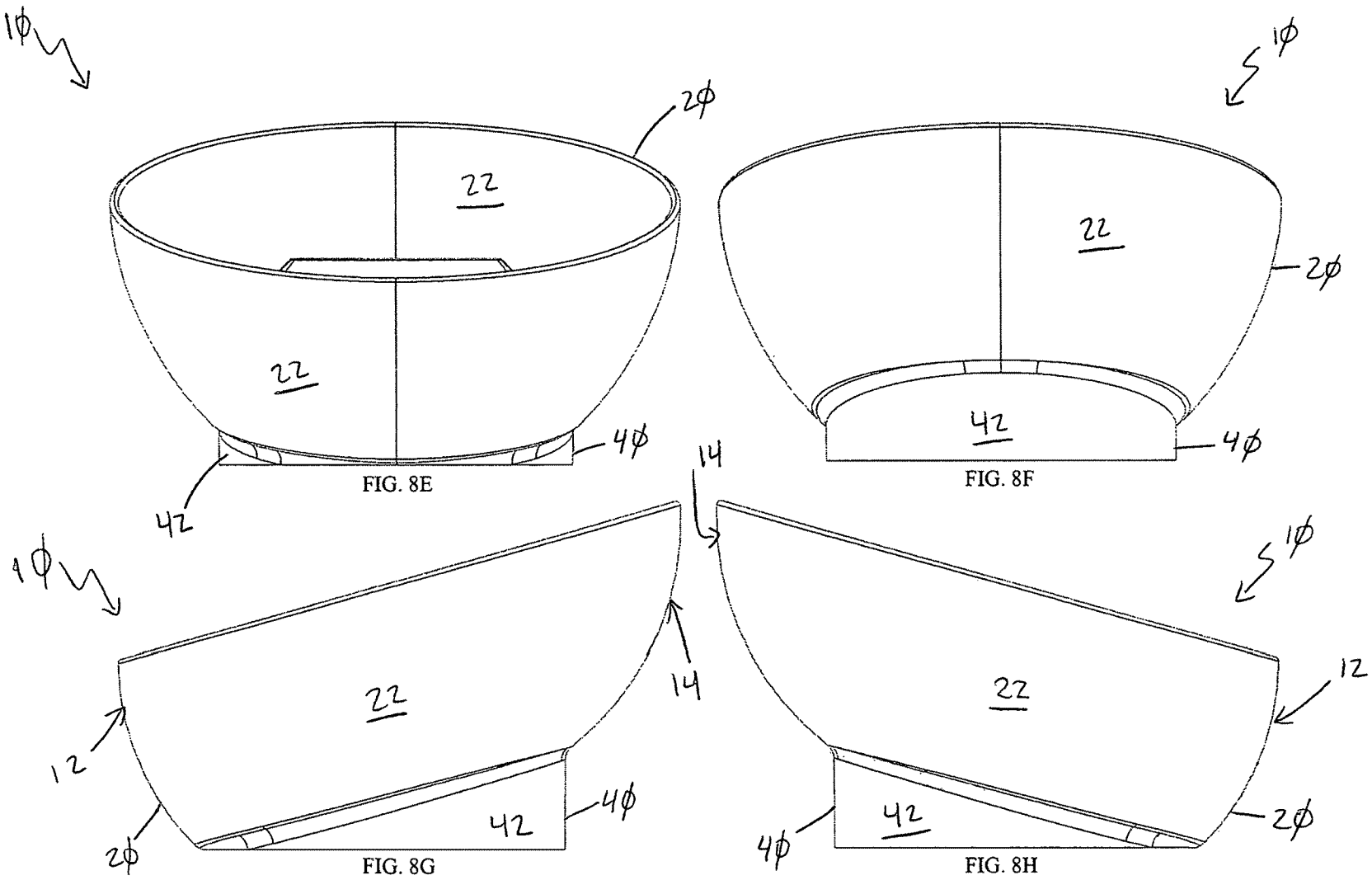
FIG. 8E is a front elevation view of the cereal bowl illustrated in FIG. 8A.
FIG. 8F is a rear view elevation view of the cereal bowl illustrated in FIG. 8A.
FIG. 8G is a right side elevation view of the cereal bowl illustrated in FIG. 8A.
FIG. 8H is a left side elevation view of the cereal bowl illustrated in FIG. 8A.

Referring to FIG. 5A, partition 30 may be substantially rectangular. In this embodiment, basin 20 may include gaps 32 that extend between basin sidewalls 22 to floor 24. Referring to FIG. 6A, partition 30 may be substantially trapezoidal. In this embodiment, partition 30 extends upwardly from juncture 34 between basin sidewalls 22 and floor 24 such that gaps 32 extend to juncture 34. Referring to FIGS. 1A, 2A and 3A, partition 30 may include outer portions 36 extending outwardly from a central portion of partition 30. In this embodiment, partition 30 extends between basin sidewalls 22 such that no there is no gap extending from floor 24 between partition 30 and basin sidewalls 22. The distance from the top of outer portion 36 to floor 24 can be varied depending upon the level of separation desired between front interior space 27 and rear interior space 28 of basin 10.

The aforementioned and heretofore described sizes, positions and geometries of partition 30 can be adapted such that basin 20 can be configured differently. For example, partition 30 having a trapezoidal shape (as shown in FIG. 6A) may include gap 32 that extends between basin sidewalls 22 to floor 24 (as shown in FIG. 5A). Alternatively, partition 30 may function as a mounting structure so that multiple partitions 30, each having different sizes and shapes, can be utilized and interchanged within a single bowl 10. For example, partition 30 may be configured such that partition members having a configuration substantially similar to the partitions 30 shown in FIGS. 1A-3A and 6A-7A can be removably positioned as a cap over partition 30 shown in FIG. 5A. In this manner, bowl 10 is reconfigurable in accordance with myriad user preferences by selecting one or more interchangeable caps having different configurations.

Base 40 is generally positioned underneath and extends away from basin 30. Although base 40 is generally depicted as circular, base 40 may be any number of shapes. In an embodiment, base 40 includes substantially continuous base walls 42 underneath basin 30, as shown in FIGS. 1(*c*)-3(*c*) and 5(*c*)-8(*c*). In this manner, base 40 defines an open space in the underside of bowl 10 such that multiple bowls are capable of nesting, as shown in FIGS. 3(*a*)-(*h*) and 4. Bottom edge 44 of base walls 42 presents a substantially flat surface that follows the circumference of base 40. Bowl 10 can thereby be evenly supported by a flat surface, such as a table or a countertop. In alternative embodiments, base 40 includes a substantially planar transverse surface (not depicted) such that based 40 forms an enclosure.

Figure 4:
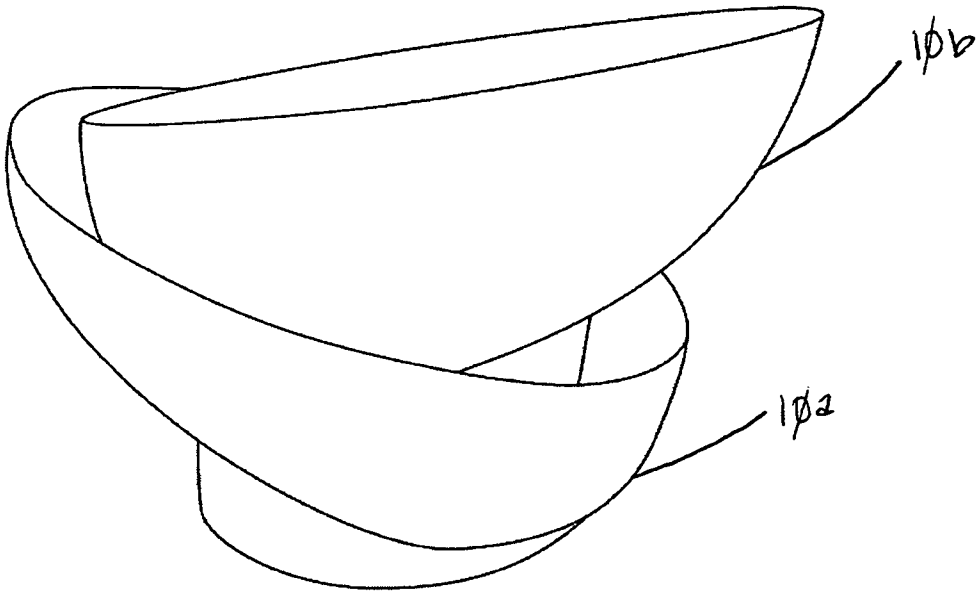
FIG. 4 is a top perspective view of cereal bowls that are stacked according to an embodiment of the present invention.

Base 40 may also include notches 45, as shown in FIGS. 2A, 2B, 2G and 2H. Notches 45 are adapted to receive a portion of partition 30. As depicted in FIG. 3A, notches 45 fit around outer portions 36 of partition 30. Notches 45 can thereby facilitate nesting of multiple bowls 10. Referring to FIGS. 3A-3B, notches 45 and partition 30 are positioned and configured such that front end 12 of first bowl 10*a* can be substantially aligned with front end 12 of second bowl 10*b* and back end 14 of first bowl 10*a* can be substantially aligned with back end 14 of second bowl 10*b*. Referring to FIG. 4, notches 45 and partition 30 may also be positioned and configured such that front end 12 of first bowl 10*a* can be substantially aligned with back end 14 of second bowl 10*b* and back end 14 of first bowl 10*a* can be substantially aligned with front end 12 of second bowl 10*b*. One skilled in the art will recognize that notches 45 and partition 30 can be positioned and configured such that first and second bowls 10*a*, 10*b* can be alternatively stacked in either of the aforementioned configurations.

Bowl 10 can be produced using standard high-volume manufacturing techniques such as plastics extrusions. Bowl 10 can also be machined, carved, pressed or 3D-printed depending upon the type of material desired or other characteristics being sought.

Figure 9:
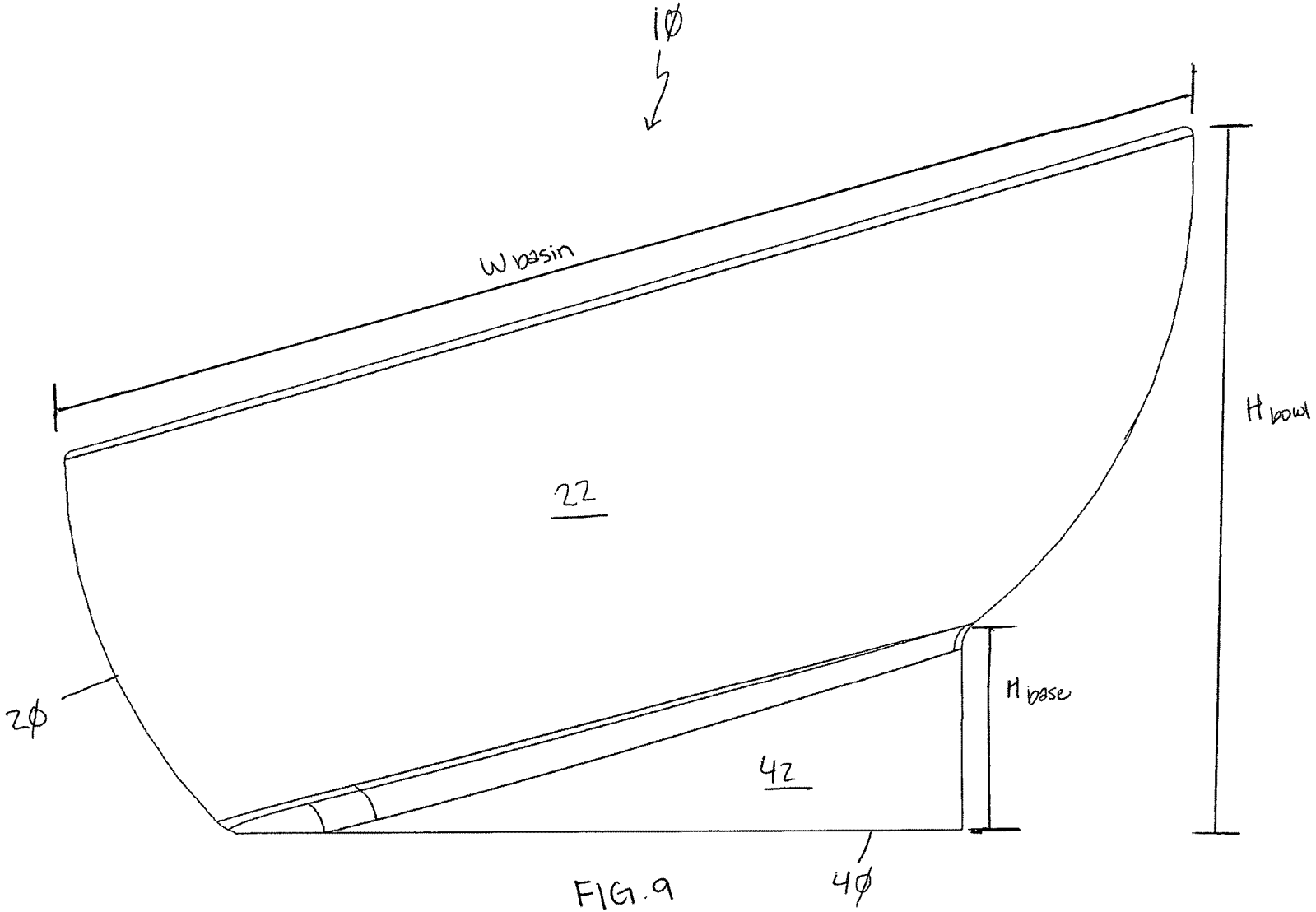
FIG. 9 is a right side elevation view of a cereal bowl according to an embodiment of the present invention.

The dimensions of bowl 10 can be varied to achieve desired characteristics pertaining to the intended use of the bowl. In particular, the dimensions can be varied as a way to influence the amount of liquid and solid material that can occupy front interior space 27 and back interior space 28 of bowl 10, such as when milk occupies front interior space 27 and dry breakfast cereal occupies back interior space 28. Referring to FIG. 9, the width, or diameter, of the outer rim of basin 30 ($W_{basin}$) can be between approximately three inches (3") and approximately ten inches (10"). In an embodiment, $W_{basin}$ is approximately seven and one-quarter inches (7¼"). The height of bowl 10 ($H_{bowl}$) can be between approximately two inches (2") and approximately eight inches (8"). In an embodiment, $H_{bowl}$ is approximately four and one-quarter inches (4¼"). The height of base 40 ($H_{base}$) is between approximately one-half inch (½") and five inches (5"). In an embodiment, $H_{base}$ is approximately one and one-half inches (1½").

Figure 10:
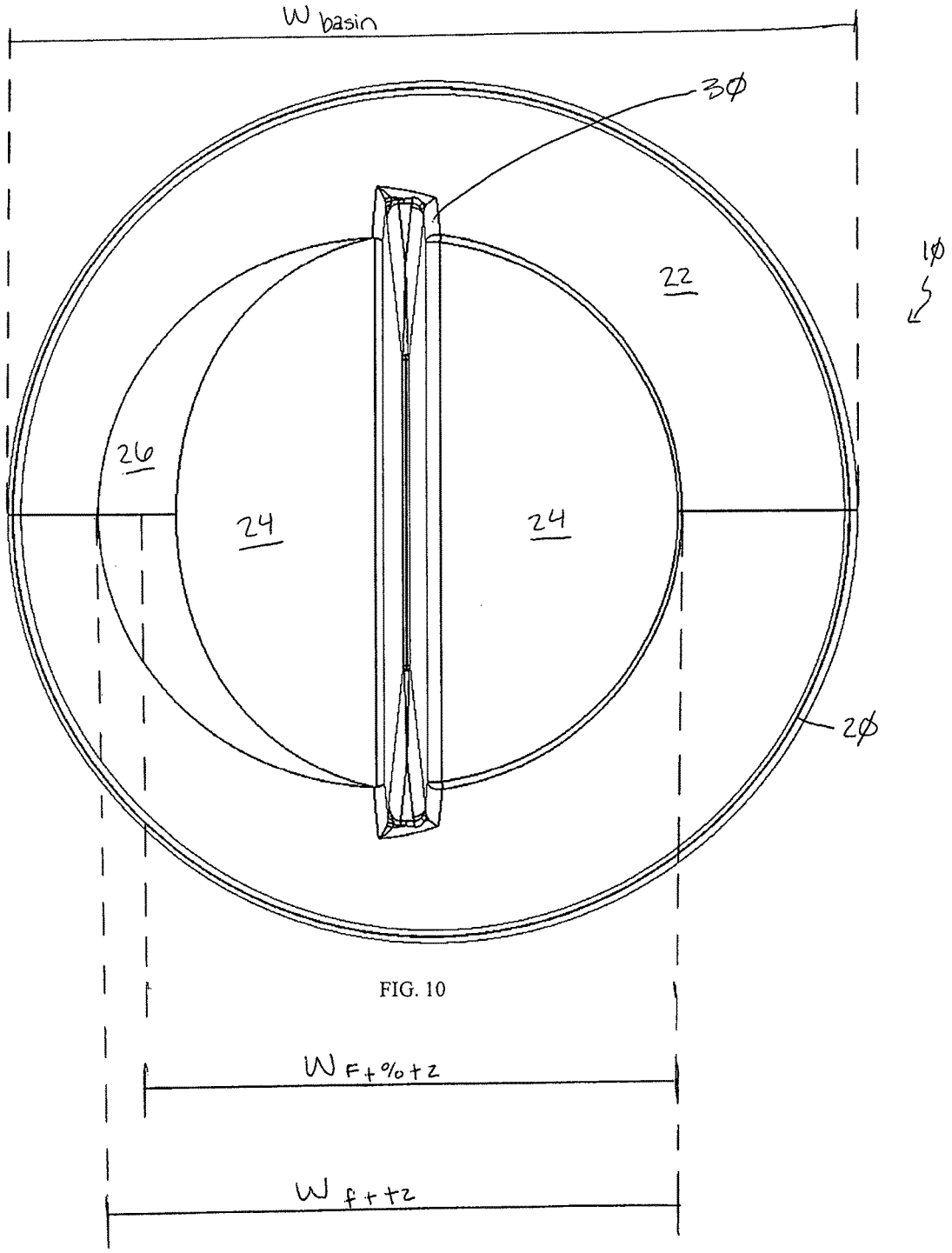
FIG. 10 is a top plan view of the cereal bowl illustrated in FIG. 9.

Referring to FIG. 10, the combined width, or diameter, of floor 24 and transition surface 25 ($W_{f+tz}$) can be between approximately two inches (2") and approximately six inches (6"). In an embodiment, $W_{f+tz}$ is approximately four and three-eighths inches (4⅜"). The combined width, or diameter, of floor and the generally horizontal portion of transition surface 25 ($W_{f+\%\ tz}$) can be between approximately two inches (2") and approximately six inches (6"). In an embodiment, $W_{f+\%\ rz}$ is approximately four and three-eighths inches (4½").

Figure 11:
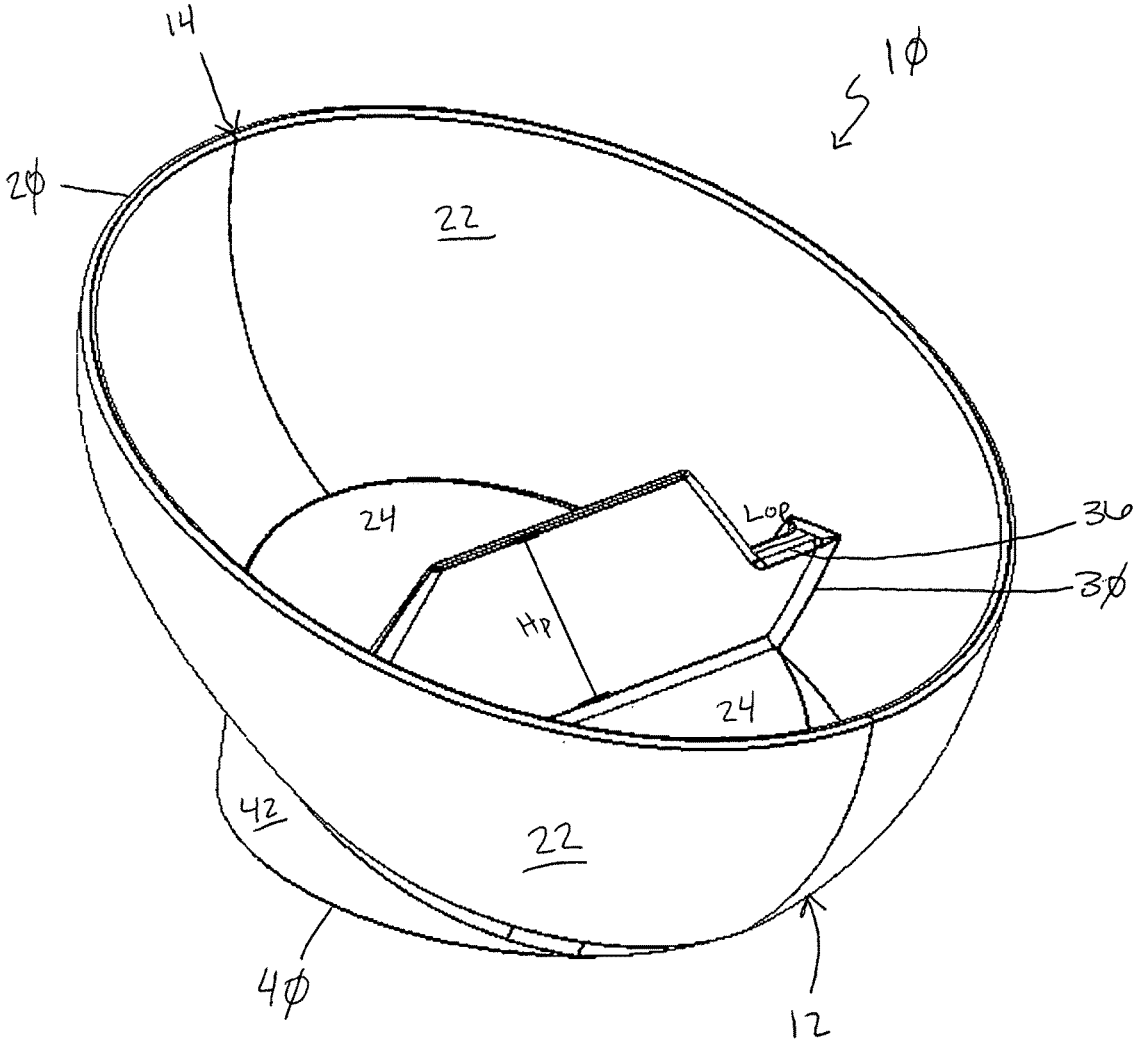
FIG. 11 is a top perspective view of the cereal bowl of FIG. 9.

Referring to FIG. 11, the height of partition 30 ($H_{partition}$) can be between one-quarter inch (¼") and approximately four inches (4"). In an embodiment, $H_{partition}$ is approximately one and one-half inches (1½"). The length of outer portion 36 of partition 30 ($L_{outer\ portion}$) can be between one-quarter inch (¼") and approximately three inches (3"). In an embodiment, $L_{outer\ portion}$ is approximately fifth-eighths of an inch (⅝").

Bowl 10 can be used for any number of purposes. Embodiments of bowl 10 described herein are particularly useful for consuming breakfast cereal. Specifically, a user may pour a desired amount of milk into front interior space 27. When bowl 10 is placed on a substantially level surface, the incline of floor 24 causes the milk to accumulate toward front end 12 of basin 30. As additional milk is added, the level of milk at front end 12 rises. When partition 30 does not extend to basin sidewalls (as shown in FIGS. 5A-5H), or extends only to juncture 34 (as shown in FIGS. 6A-6H), a user can also pour milk into back interior space 28. Gravity then causes milk to flow downward along floor 24 and around partition 30 while still accumulating in front end 12 of bowl 30.

A user can maintain dry breakfast cereal separate from milk by dispensing a desired amount of breakfast cereal into back interior space 28. Due to the presence of partition 30, the breakfast cereal will substantially accumulate in back interior space 28 between partition 30 and portions of basin sidewalls 22 located at back end 14 of bowl 10. Outer portions 36 of partition 30 provides a barrier that substantially prevents breakfast cereal from passing from back interior space 28 to front interior space 27. Although some cereal may pass from back interior space 28 to front interior space 27 in embodiments of bowl 30 with gap 32 between basin sidewalls 22 and partition, friction between breakfast cereal and floor 24, as well the inherent stability of a matrix of breakfast cereal, can inhibit breakfast cereal from passing from back interior space 28 to front interior space 26.

To consume breakfast cereal, a user can utilize a kitchen utensil, such as a spoon, to gather a desired amount of the breakfast cereal. The user can then transfer breakfast cereal to the milk contained in the front interior space 27 of bowl 10. The parabolic shape of basin sidewalls 22 facilitates this transfer. Specifically, the basin sidewalls 22 provide a support surface that reduces the opportunity for breakfast cereal to fall from the spoon. The concave shape of the basin sidewalls 22 is particularly well-suited to conform around an amount of dry breakfast cereal carried by the spoon.

By immersing the spoon in the milk contained in front interior space 27, the user can thereby cause milk to accumulate in the spoon. This significantly reduces the amount of time that the breakfast cereal will remain in contact with the milk, which in turn reduces the ability of the breakfast cereal to absorb milk and become soggy prior to consumption. As a result, Captain Crunch® will stay crunchy, Cookie Crisp® will stay crisp, and Rice Krispies® will continue to snap, crackle and pop. Users with different consumption preferences can transfer breakfast cereal to the milk for varying amounts of time as required for desired milk absorption and crispiness.

An additional feature and advantage of the present invention is the ability to store bowl 10 after use, or display bowl 10 for sale. Specifically, cavity 26 is adapted to receive partition 30. In certain embodiments, notches 45 are adapted to fit about outer portions 36 of partition 30. In this manner, multiple bowls 30 can be successively stacked, or nested. Although FIGS. 3A-3H and 4 illustrate a pair of bowls 10, three or more bowls could easily be stacked together. Bowls 30 may be stacked in unidirectional alignment (FIGS. 3A-3H) or in a mirror-image alignment (FIG. 4).

Various embodiments of the invention have been described above for purposes of illustrating the details thereof and to enable one of ordinary skill in the art to make and use the invention. The details and features of the disclosed embodiment(s) are not intended to be limiting, as many variations and modifications will be readily apparent to those of skill in the art. Accordingly, the scope of the present disclosure is intended to be interpreted broadly and to include all variations and modifications coming within the scope and spirit of the appended claims and their legal equivalents.

The invention claimed is:

1. A receptacle for separating a liquid from solid food items, comprising:

a basin having a floor and sidewalls surrounding the floor;

a base extending generally downwardly from the floor and adapted to support the basin on a surface; and a partition extending generally upwardly from the floor to form a first compartment and a second compartment, wherein there is a first gap between the sidewalls and the partition at a first juncture and there is a second gap between the sidewalls and the partition at a second juncture;

wherein the partition and the floor define a cavity therein, the cavity adapted to receive a portion of a second partition from a second receptacle.

2. The receptacle of claim 1, wherein a central portion of the partition extends along the floor between first and second locations on the sidewalls and includes first and second outer portions, the central portion extending above the first and second outer portions.

3. The receptacle of claim 2, wherein the base of the basin has first and second notches adapted to receive first and second outer portions of the second partition of the second receptacle.

4. The receptacle of claim 3, wherein:

the second receptacle includes a second base; and the basin of the receptacle is adapted to receive the second base of the second receptacle so that the first and second receptacles are substantially vertically aligned.

5. The receptacle of claim 4, wherein the receptacle can receive the second base in a first orientation or a second orientation, a front end of the receptacle being substantially vertically aligned with a front end of the second receptacle in the first orientation and the front end of the receptacle being substantially vertically aligned with a back end of the second receptacle in the second orientation.

6. The receptacle of claim 1, wherein the floor is positioned at an incline in relation to the surface supporting the basin.

7. The receptacle of claim 1, wherein the sidewalls are substantially concave.

8. The receptacle of claim 1, wherein:

the partition extends from the first juncture of the sidewalls and the floor to the second juncture of the sidewalls and the floor; and the partition is substantially trapezoidal in shape so that the first gap is between the sidewalls and the partition at the first juncture and the second gap is between the sidewalls and the partition at the second juncture.

9. The receptacle of claim 1, wherein the partition is adapted to receive a cap.

10. The receptacle of claim 9, wherein:

the cap includes a central portion and first and second outer portions extending therefrom, the central portion extending above the first and second outer portions; and the partition is configured such that, when the cap is situated about the partition, the cap extends along the floor between first and second locations on the sidewalls such that the first and second outer portions substantially occupy the gap.

11. The receptacle of claim 9, wherein:

the cap is substantially trapezoidal in shape and the partition is configured such that, when the cap is attached, the cap extends from a first juncture of the sidewalls and the floor to a second juncture of the sidewalls and the floor.

12. The receptacle of claim 1, wherein a ratio of a diameter of the base to a diameter of the basin is between approximately 3:4 to approximately 1:4.

13. The receptacle of claim 12, wherein the ratio is approximately 3:5.

14. The receptacle of claim 1, wherein the first compartment can hold a volume of at least 1 cup of a liquid without the liquid entering over into the second compartment.

15. A receptacle for separating a liquid from solid food items, comprising:

a basin having a floor and sidewalls surrounding the floor;

a base extending generally downwardly from the floor and adapted to support the basin on a surface; and a partition extending generally upwardly from the floor to form a first compartment and a second compartment wherein the partition is configured such that there is a first gap between the sidewalls and a first portion of the partition, and such that there is a second gap between the sidewalls and a second portion of the partition;

wherein:

a second receptacle includes a second base and a second partition;

the partition and the floor of the basin define a cavity therein, the cavity adapted to receive a portion of the second partition;

the receptacle can receive the second base in a first orientation or a second orientation, a front end of the receptacle being substantially vertically aligned with ta front end of the second receptacle in the first orientation and the front end of the receptacle being substantially vertically aligned with a back end of the second receptacle in the second orientation;

the floor is positioned at an incline in relation to the surface which supports the base; and the sidewalls are substantially concave.

16. A method of storing food receptacles, the method comprising:

providing a first receptacle, the first receptacle comprising:

a first basin having a first floor and sidewalls surrounding the first floor;

a first base extending generally downwardly from the first floor and adapted to support the first basin on a surface; and a first partition extending generally upwardly from the first floor to form a first upper compartment and a first lower compartment;

providing a second receptacle, the second receptacle comprising:

a second basin having a second floor and sidewalls surrounding the second floor;

a second base extending generally downwardly from the second floor and adapted to support the second basin on the surface; and a second partition extending generally upwardly from the second floor to form a second upper compartment and a second lower compartment;

wherein the first partition and the first floor define a first cavity therein, the first cavity adapted to receive a portion of the second partition;

situating a first cap over the first partition such that the first cap extends along the first floor between the sidewalls of the first receptacle;

situating a second cap over the second partition such that the second cap extends along the second floor between the sidewalls of the second receptacle; and nesting the second receptacle in the first receptacle in a substantially vertically aligned position.

17. The method of claim 16, further comprising positioning the second receptacle on the first receptacle in a first orientation wherein a front end of the first receptacle is substantially vertically aligned with a front end of the second receptacle.

18. The method of claim 17, further comprising positioning the second receptacle on the first receptacle in a second orientation wherein the front end of the first receptacle is substantially vertically aligned with a back end of the second receptacle.

* * * * *